United States Patent [19]

Sugiyama et al.

[11] 4,412,640

[45] Nov. 1, 1983

[54] APPARATUS FOR ATTACHING A PLURALITY OF STUDS ON FLEXIBLE SHEET MATERIAL

[75] Inventors: Akira Sugiyama, Nagoya; Kunio Hirota, Aichi, both of Japan

[73] Assignee: Brother Kogyo Kabushiki Kaisha, Japan

[21] Appl. No.: 330,084

[22] Filed: Dec. 14, 1981

[30] Foreign Application Priority Data

Dec. 20, 1980 [JP] Japan ..... 55-181076
Jan. 20, 1981 [JP] Japan ..... 56-7586

[51] Int. Cl.[3] ..... B27F 7/21

[52] U.S. Cl. ..... 227/85; 29/563; 29/564.1; 29/701; 227/2; 227/92; 227/104

[58] Field of Search ..... 29/563, 564, 564.1, 29/701; 227/2, 3, 4, 5, 78, 85, 92, 100, 101, 104

[56] References Cited

U.S. PATENT DOCUMENTS 2,814,803 12/1957 Northup ..... 227/2
3,641,651 2/1972 Rockwell, Jr. ..... 29/701
3,727,284 4/1973 Ragard et al. ..... 227/2
3,837,063 9/1974 Wright ..... 227/2
4,080,730 3/1978 Woodman, Jr. ..... 29/701

FOREIGN PATENT DOCUMENTS 29-6842 4/1954 Japan .
43-4162 2/1968 Japan .
48-40033 11/1973 Japan .

*Primary Examiner*—Paul A. Bell
*Attorney, Agent, or Firm*—Leydig, Voit, Osann, Mayer & Holt, Ltd.

[57] ABSTRACT

An apparatus for attaching a plurality of studs on a flexible sheet material such as work fabric, leather or the like according to a desired pattern comprizes a holder for holding the sheet material, a supply device for supplying studs severally, a plastic working device including a punch and die set for attaching the studs on the sheet material, and a drive device for varying the relative position between the holder and the plastic working device. The studs may be supplied severally and attached sequentially to the sheet material while the relative position between the holder and the plastic working device is varied by the drive device.

8 Claims, 26 Drawing Figures

APPARATUS FOR ATTACHING A PLURALITY OF STUDS ON FLEXIBLE SHEET MATERIAL

FIELD OF THE INVENTION

This invention relates to an apparatus for attaching or mounting of a plurality of studs to the flexible sheet material such as fabric or leather.

BACKGROUND OF THE INVENTION

It may become necessary from time to time that a number of studs P be attached to a flexible sheet material W such as fabric or leather for providing on the sheet material a desired pattern shown exemplarily in FIGS. 1 to 3. Heretofore, studs P had to be attached to desired places on the sheet material W by a laborious and time-consuming manual operation with the aid of stud driving tools.

SUMMARY OF THE INVENTION

It is an object of the present invention to provide an apparatus for attaching a plurality of studs on a flexible sheet material such as work fabric, leather etc. whereby the studs can be attached severally and automatically for improving operational efficiency.

It is another object of the invention to provide an apparatus for attaching a plurality of studs on the flexible sheet material whereby the relative position between a holder holding the flexible sheet material and plastic working means is changed in accordance with a predetermined program stored in memory means for sequentially attaching the studs on the sheet material.

It is another object of the invention to provide an apparatus for attaching a plurality of studs on the flexible sheet material whereby the studs may be punched and formed from a metal strip and the studs thus prepared may be attached in situ sequentially and automatically on the sheet material.

It is yet another object of the present invention to provide an apparatus for attaching a plurality of studs on the flexible sheet material whereby the studs of the desired ultimate shape may be punched and formed severally from a metal strip by the aid of a plurality of punch and die sets and the studs thus prepared may be attached in situ on the flexible sheet material.

It is a further object of the present invention to provide an apparatus for attaching a plurality of studs on a flexible sheet material whereby studs are punched out from a metal strip and the punched studs are then formed by drawing so that head portions of the studs may extend towards the sheet material, the studs being then reversed in their position so that leg portions of the studs may face to the sheet material, the reversed studs being then caused to pierce through the sheet material by a punch and die set disposed oppositely on both side of the sheet material, the material and the metal strip being advanced to the next stud attaching position and the next working position respectively while the punch and die are separated from one another; so that the punching, forming and mounting operations of the studs can be take place on a vertical straight line connecting the sheet material and the metal strip without causing any shift between the stud forming position and the stud attaching position.

Other features of the present invention will become apparent from the following description of the two preferred embodiments taken in connection with the accompanying drawings.

BRIEF DESCRIPTION OF THE DRAWINGS

FIGS. 4 to 15 show a first embodiment of the invention, wherein

FIG. 4 is a perspective view of the overall apparatus;

FIG. 5 is an enlarged sectional view showing essential parts of the apparatus with the ram being shown in its upper operative position;

FIG. 6 is an enlarged sectional veiw similar to FIG. 5 but with the ram being shown in its lower operative position;

FIG. 7 is a sectional view taken along 7—7 of FIG. 5;

FIG. 8 is a sectional veiw taken along line 8—8 of FIG. 6;

FIG. 9 is a block diagram showing the electrical components of the apparatus;

FIG. 10 is a schematic view showing presser and drive rollers, shown partly in section;

FIG. 11 is a simplified front view for illustrating the winding of the metal strip;

FIG. 12 is a simplified view showing the drive system of the apparatus;

FIG. 13 is a front view of the ram and crank cooperating therewith;

FIG. 14 is a top plan view showing the working process for the metal strip;

FIG. 15 is a perspective view showing the same process as that of FIG. 14;

FIGS. 16 to 26 show a modified embodiment of the present invention, wherein FIG. 16 is a perspective view of the overall apparatus;

FIG. 17 is a front sectional view showing the overall stud attaching unit;

FIG. 18 is a sectional side elevation thereof;

FIGS. 19 to 21 are enlarged sectional views of seential parts showing different operating states of the apparatus;

FIG. 22 is a side elevation of the presser and drive rollers. shown partly in section;

FIG. 23 is a simplified front view showing the winding process of the metal strip;

FIG. 24 is perspective view for illustrating the steps from blanking until mounting of the studs on the sheet material;

FIG. 25 is a block diagram showing electrical components of the apparatus; and FIG. 26 is timing chart for illustrating the operational sequence of the apparatus.

DESCRIPTION OF THE PREFERRED EMBODIMENTS

FIRST EMBODIMENT

Figure 1:
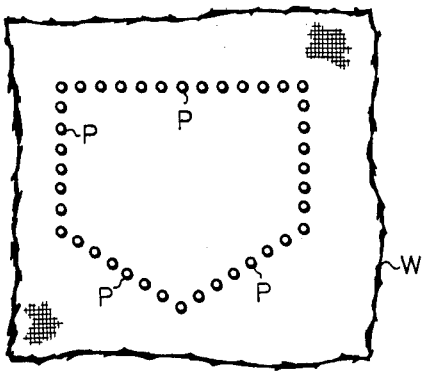
FIGS. 1 to 3 show decorative studs attached to the sheet material in different patterns.

Reference is made to FIGS. 4 through 15 for illustrating a prefered first embodiment of the present invention. A table 3 is mounted as extension of a front portion of a bed 2 of a frame 1. A stud attaching apparatus 4 having about the same profile as a sewing machine arm, is mounted on the upper surface of the bed 2 so that a head 5 thereof is positioned on top said table 3.

Below said attaching apparatus 4, there is mounted a movable member 10 on the upper surface of the bed 2 so as to be movable along an X-axis (transversely or in the left and right direction) and along a Y-axis (longitudinally or in the fore and aft direction). An X-axis rack 12 having four end rollers 11 for holding the longitudinally side of the movable member 10 meshes with a gear 14 secured to an output shaft of an X-axis feed pulse motor 13, so that forward and reverse rotation of the motor 13 results in an X-axis feed movement of the movable member 10. In a similar manner, a Y-axis rack 16 having four end rollers 15 for holding the transverse side of the movable member 10 meshes with a gear 18 secured to an output shaft of a Y-axis feed pulse motor 17, so that forward and reverse rotation of the motor 17 results in a Y-axis feed movement of the movable member 10.

Above said table 3, a holder 19 is mounted to the foremost part of the member 10 so as to be positioned below the head 5 of the stud attaching apparatus 4 and be movable along the X- and Y-axes together with the movable member 10. The movable member 10, racks 12, 16 and the pulse motor 13, 17 constitute drive means for varying the position of the holder 19 along the X- and Y-axes. The holder 19 is composed of a supporting base plate 20 in the form of a rectangular frame, and a presser plate 21 in the form of a similar rectangular frame, which is designed for opening and closing relative to the upper surface of the base plate 20, so that the flexible sheet material W such as fabric or leather may be clamped between the plates 20 and 21. The presser plate 21 is biased by a spring, not shown, in a direction to clamp the material W thereby. An arm 22 is pivotally mounted to the rear side of the movable member 10 and has its end connected to the presser plate 21. Rotation of raising pulse motor 23 mounted laterally of the arm 22 causes the arm 22 to swing about its fulcrum for pivoting the presser plate 21 in the opening direction.

A supplying roll 24 and winding roll 25 are mounted to the left and right sides of the bed 2, respectively, so that a band steel C placed about the supplying roll 24 may travel below the head 5 of the stud attaching apparatus 4 and be taken up on the winding roll 25.

At the end of the bed 2 towards said winding roll 25, there are mounted a rubber presser roller 26 and a rubber driving roller 27 for clamping said band steel C as a metal strip from above and below.

Figure 10:
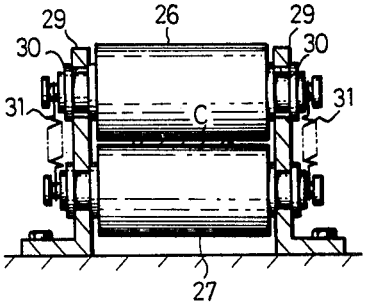

A feeding pulse motor 28 has its output shaft connected to said driving roller 27 in such a manner that rotation of the motor 28 by predetermined increments causes intermittent transfer of the band steel C towards winding roll 25 by predetermined amounts. As shown in FIG. 10, the presser roller 26 and the driving roller 27 are supported between a pair of supporting plates 29 each of which has a vertically oblong supporting bore 30 for supporting the presser roller 26 so as to allow for small vertical movement of the presser roller 26. The roller 26 is biased by a spring, not shown, in a direction to clamp the band steel C between it and the drive roller. The feeding pulse motor 28, presser roller 26 and driving roller 27 constitute feed means for feeding the band steel C through a space above the flexible sheet material W which is held by the holder 19.

Figure 11:
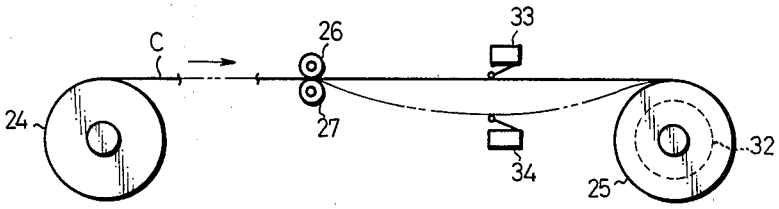

The winding roll 25 may be rotated stepwise by suitable increments by operation of a winding pulse motor 32. Further, as shown in FIG. 11, between the winding roll 25 and the presser and driving rollers 26, 27, an upper limit switch 33 and a lower limit switch 34 are mounted above and below the band steel C, respectively. The lower limit switch 34 is activated, when the band steel has sagged, for causing rotation of the winding pulse motor 32 and hence rotation of the winding roll 25 in the winding direction. The upper limit switch 33 is activated, when the band steel C has become taut as a result of winding for terminating the rotation of the winding pulse motor 32 and hence the winding of the band steel C.

Figure 14:
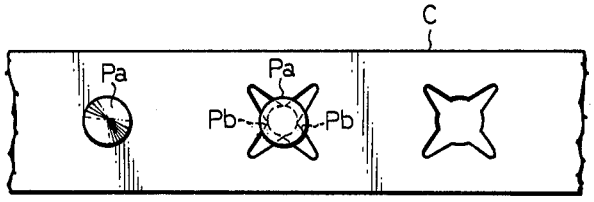
Figure 15:
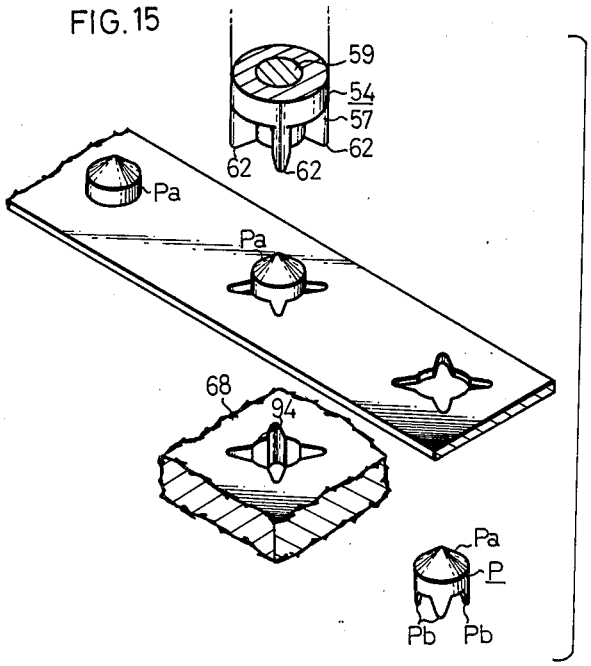

The band steel C, transferred from supplying roll 24 towards winding roll 25 as described above, is subjected to a punching operation in zone between the head 5 of the apparatus 4 and the table 3, as shown in FIGS. 14 and 15 so that a stud P is punched therefrom and driven into the sheet material W held by holder 19. The structure for effecting such operation will be described below in more detail.

Figure 12:
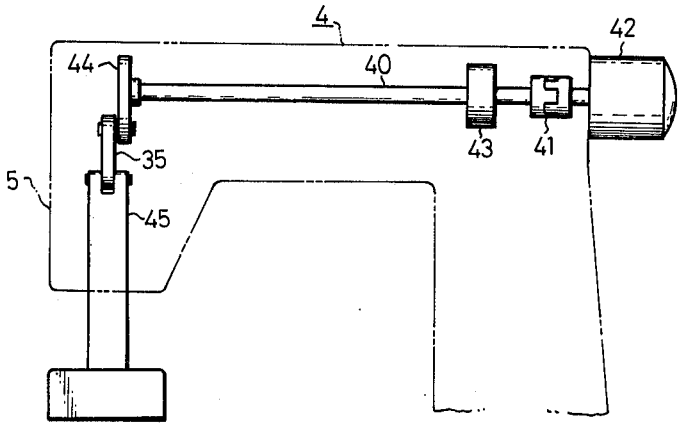
Figure 13:
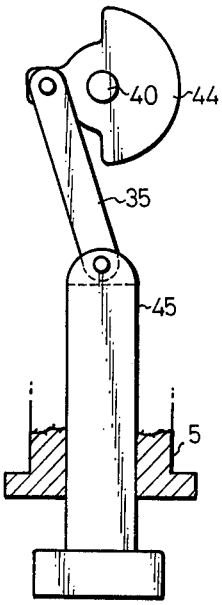

As shown in FIGS. 12 and 13, a drive shaft 40 is supported in an upper portion of the frame of the stud attaching apparatus 4 and is driven in rotation by a driving motor 42 to which the shaft 40 is connected by a coupling 41. A flywheel 43 is mounted to a part of said drive shaft 40, while a crank 44 is mounted to the end of the drive shaft 40.

Figure 5:
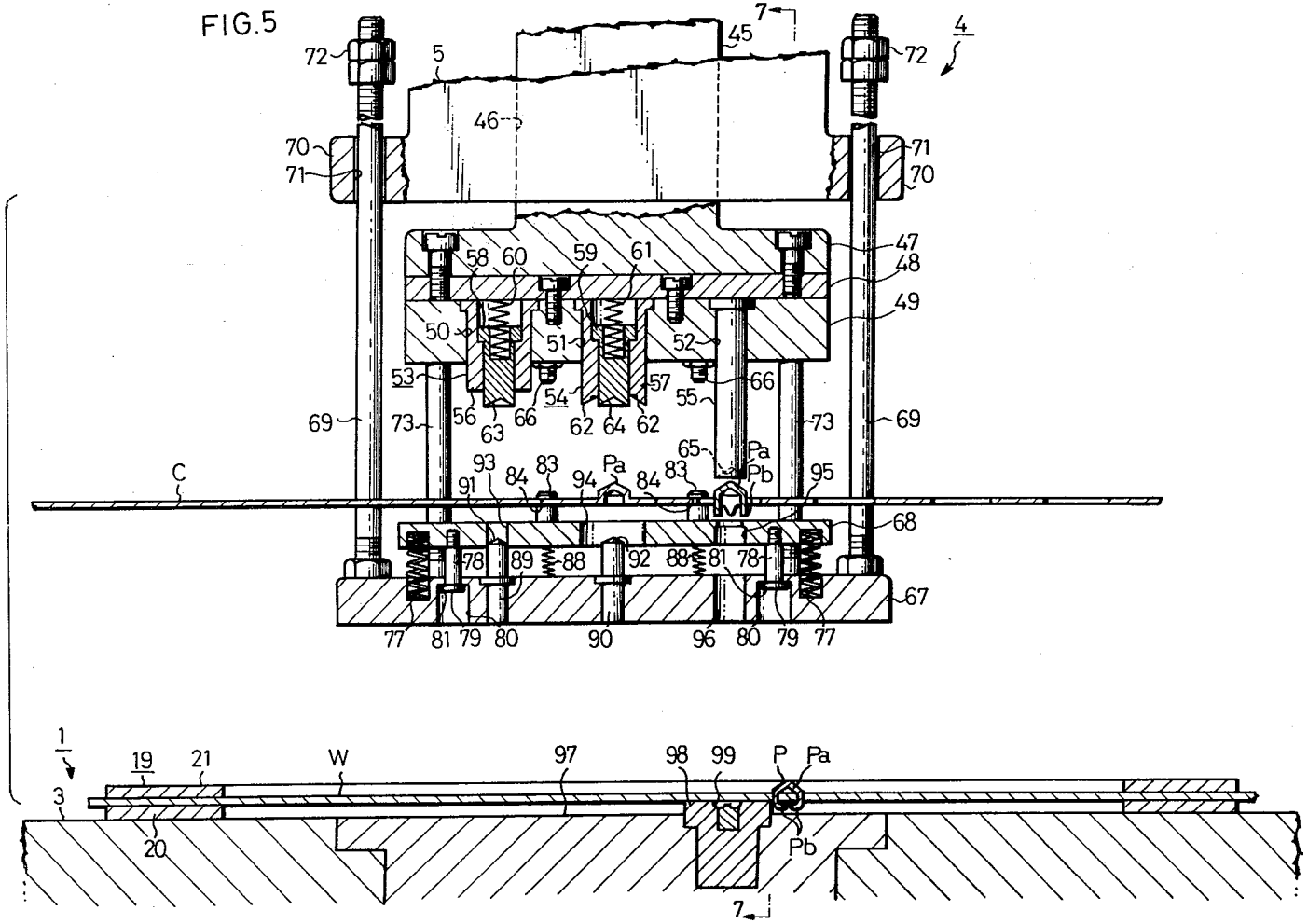
Figure 6:
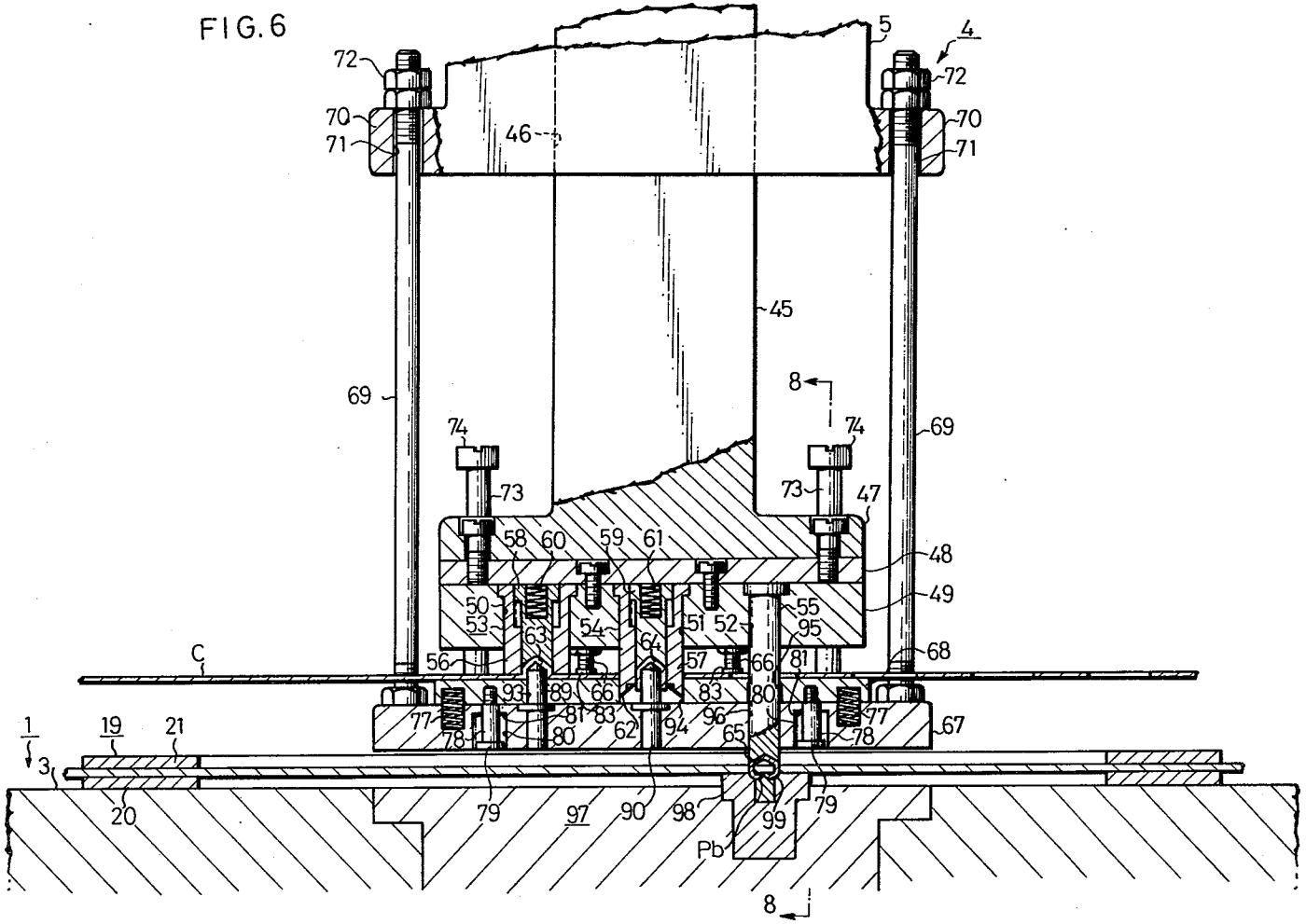
Figure 7:
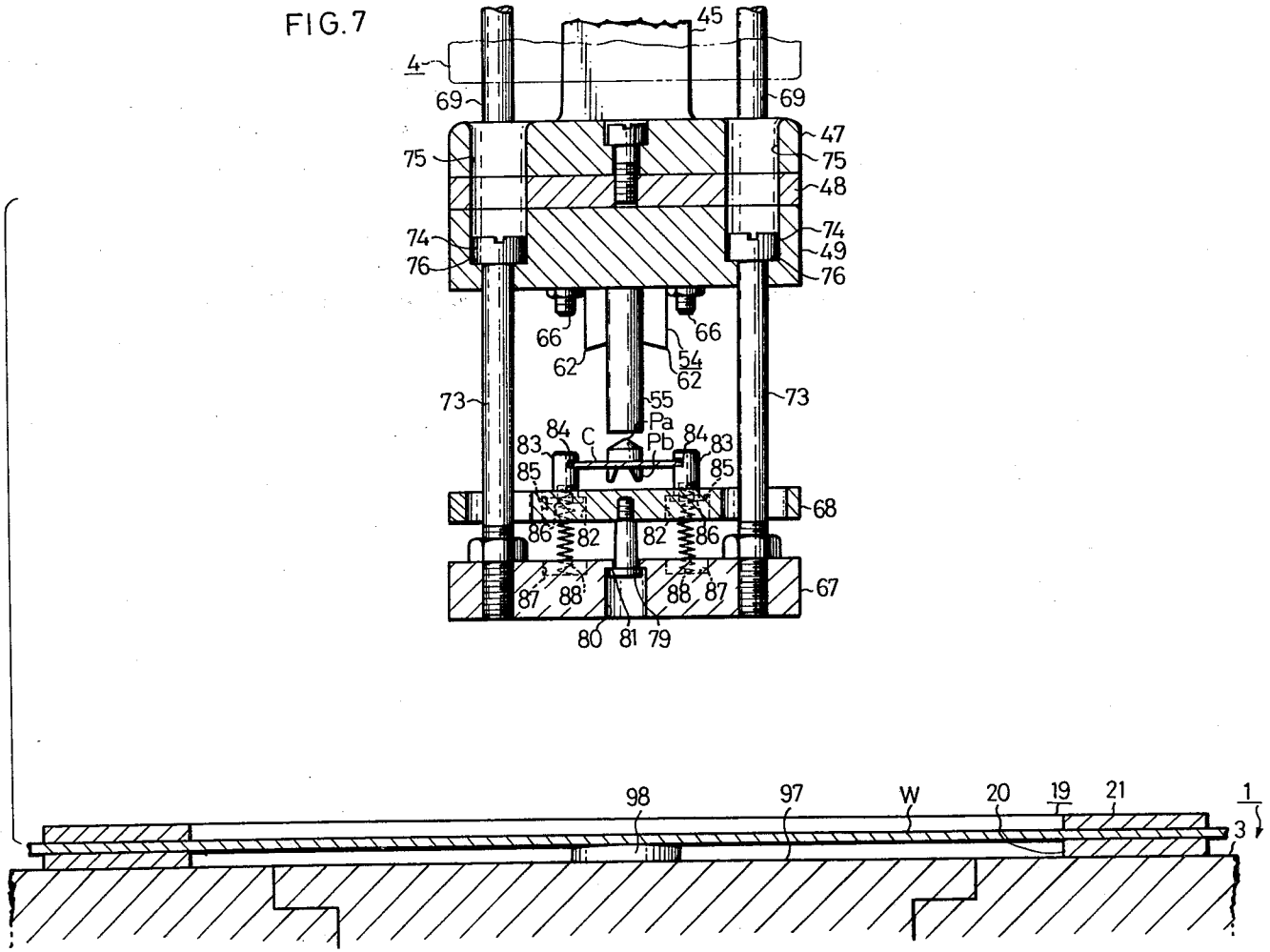
Figure 8:
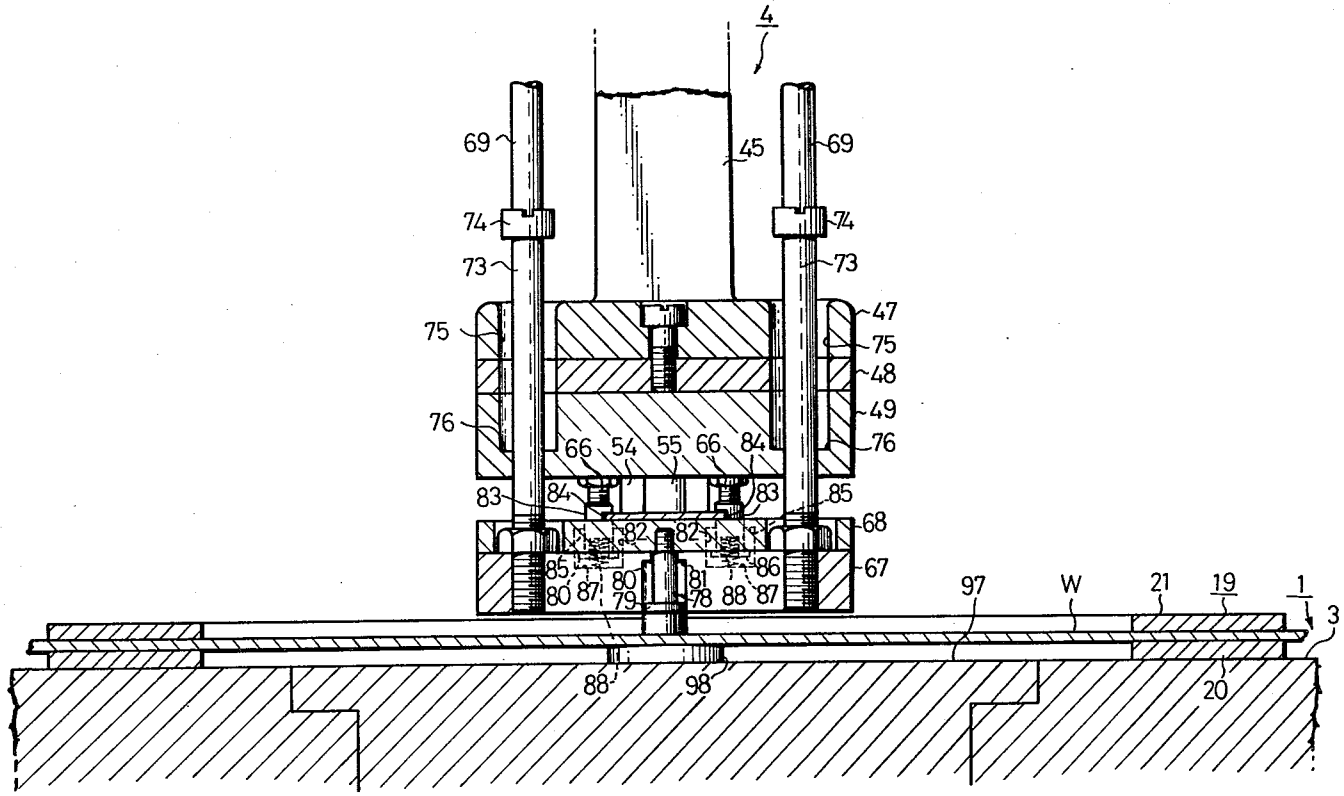

As shown in FIGS. 5 through 8, 12 and 13, a ram 45 mounted to the head 5 of the stud attaching apparatus 4 has its upper end connected to said crank 44 through a link 35 and, upon rotation of said drive shaft 40, may be guided along a guide way 46 formed on the head 5 so as to reciprocatingly travel between an upper position shown in FIGS. 5 and 7 and a lower position shown in FIGS. 6 and 8. To the lower surface of an attaching potion 47 which is formed at the lower end of the ram 45, a supporting plate 49 is secured by the medium of a further supporting plate 48. Three supporting bores 50, 51, 52 are formed through the supporting plate 49 along the transfer path of the band steel C and at intervals equal to the intermittent feed pitch of the band steel C, and a first step die 53, a second step die 54 and a third step punch 55 are inserted into and secured to these bores 50, 51, 52, respectively.

The first and second step dies 53, 54 are composed of outer dies 56, 57, inner dies 58, 59 mounted vertically movably within outer dies 56, 57 and movable between a position extending downwards from said outer dies 56, 57 and a position completely accommodated within the outer dies 56, 57, and springs 60, 61 for biasing the inner dies 58, 59 downwards, respectively. Four cutting portions 62 are formed at equal intervals at the lower end of the outer die 56 of the second step die 54. The lower end faces of the inner dies 58, 59 are designed as forming surfaces 63, 64 that are recessed gently towards the centers. The third step punch 55 is extended more pronouncedly from the supporting plate 49 and has a lower end face designed as forming surface 65 similar to the forming surfaces 63, 64, and lower peripheral edge designed as cutting edge.

To the fore and aft sides of the first and second step dies 53, 54, that is, at the left and right sides when seen in FIGS. 7 and 8, presser screws 66 are mounted to the supporting plate 49 and extended therefrom downwards. These presser screws 66 are provided in two pairs along the transfer path of the band steel C and may be adjustable in their extending distances.

A punch plate 67 and stripper plate 68 positioned thereabove are placed below the supporting plate 49. The band steel C travels above the stripper plate 68. First guide rods 69 are mounted upright at four corners of the punch plate 67. The lower end of the head 5 has extending portions 70 each of which has two through guide bores 71 for passage of the first guide rods 69. Each of said first guide rods 69 has an upper threaded portion to which a stopper 72 consisting of a double nut is screwed. When the punch plate 67 is positioned at the lower portion shown in FIG. 6, the stopper 72 abuts on the upper surface of the extending portion 70.

Slightly inwardly of the first guide rods 69, second guide rods 73 are mounted upright at four corners of the punch plate 67, these guide rods 73 having heads 74 at the upper ends and being inserted through guide bores 75 which pass through the attaching portions 47 at the lower end of the ram 45 and into said supporting plate 49. The lower ends of the guide bores 75 provide stopper surfaces 76 with which the heads 74 of the second guide rods 73 are engaged for suspending the punch plate 67 when the ram 45 has reached the upper position shown in FIG. 7.

The stripper plate 68 is biased by two springs 77 interposed between both ends of the punch plate 67 and both ends of the stripper plate 68. Guide pins 78 having heads 79 at the lower ends are attached to the lower surface of the stripper plate 68 in the vicinity of the springs 77. The punch plate 67 is formed with through guide bores 80 through which the guide pins 78 are passed and which have inner peripheral stopper surfaces 81. With the ram 45 being in its upper position and the punch plate 67 being suspended as shown in FIG. 5, the stripper plate 68 is slightly floated from the upper surface of the punch plate 67 and kept in this position under the force of the springs 77 and by virtue of the engagement between the heads 79 of the guide pins 78 and the stopper surface 81 of the guide bores 80.

On both sides of the transfer path of the band steel C, the stripper plate 68 has through bores 82, into which holding pins 83 are introduced for vertical movement and in opposition to the presser screws 66. The upper ends of the guide pins 83 are formed with holding grooves 84 into which the travelling band steel C is engaged edgewise, while the lower ends of the pins are formed with heads 86 engaged with inner peripheral stopper surface 85 of the bores 82. The punch plate 67 has recesses 87 in register with bores 82 and a spring 88 is interposed between the bottom of each recess 87 and the holding pin 83 for upwardly biasing the associated holding pin 83.

With the ram 45 being in its upper position and the stripper plate 68 being floated as shown in FIGS. 5 and 7, the holding pins 83 are kept in their upper positions under the action of the springs 88 and due to engagement between the heads 86 of the holding pins 83 and the stopper surfaces 85 of the bores 82. The band steel C, engaged edgewise in the holding grooves 84 of the holding pins 83, is slightly floated from the stripper plate 68.

With the ram 45 being in the lower position as shown in FIGS. 6 and 8, the band steel C is pressed down by the first and second step dies 53, 54. The holding pins 83 are pressed down by the presser screws 66 provided to the lower surface of the supporting plate 49 so that the band steel C is strongly passed against the upper surface of the stripper plate 68. Due to such pressure, the stripper plate 68 is abutted on the punch plate 67 which is then lowered to a position defined by engagement between the extending portion 70 and the stopper 72. It is to be noted that, when the ram 45 has been raised and the punch plate 67 suspended as shown in FIGS. 5 and 7, a larger space is defined between the upper surface of the table 3 and the lower surface of the punch plate 67 to facilitate the opening and closure of the holder 19. On the contrary, when the ram 45 has been shifted to its lower position and thus the punch plate 67 remains in its lower position, a small clearance is left between the lower surface of the punch plate 67 and the holder 19 for preventing possible collision among the lower surface of punch plate 67, holder 19 and studs P as described below.

In register with the inner dies 58, 59 of the first and second step dies 53, 54, first and second step punches 89, 90 are secured to said punch plate 67 to extend therefrom and are formed at the upper ends with obtusely pointed forming surfaces 91, 92, respectively. The stripper plate 68 has two through bores 93, 94 through which the punches 89, 90 may be extended upwards when the ram 45 is shifted to its lower position as shown in FIGS. 6 and 8. The diameter of the bore 94 associated with the second step punch 90 is such that the outer die 57 of the second step die 54 may be introduced into the bore 94 from above. Through bores 95,96 are formed in the stripper plate 68 and the punch plate 67 in register with third step punch 55 which may thus be extended down through these bores 95, 96 when the ram 45 is shifted to its lower position.

With the ram 45 being in its lower position, as shown in FIGS. 6 and 8, the band steel C is subjected to a primary forming step between the inner lower periphery of the outer die 56 of the first step die 53 and the forming surface 63 of the inner die 58 and between the upper periphery and forming surface 91 of the first step punch 89, so that a head portion Pa of a stud P having an obtusely pointing upper portion may be formed by drawing. The cutting portions 62 of the second step die 54 are extended radially in the form of acute-angled triangles. The bore 94 is similarly contoured as the outer contour of the second step die 54. Through cooperation between the second step die 54 and the bore 94, the head portion Pa is cut along its periphery with four radially contiguous leg portions Pb in the form of acute-angled triangles. Then, by cooperation between the second step punch 90 and the outer die 57 of the second step die 54, the leg portions Pb may be bent down as shown in the bottom portion of FIG. 15.

The first step die 53 with the first step punch 89 and the second step die 54 with the second step punch 90 constitute first plastic working means whereby the band steel C is drawn for providing the head portion Pa of the stud P and plural leg portions Pb are cut and bent so as to extend oppositely to the head portion Pa.

Below said punch plate 67, a die holder 97 is secured to the table 3 flush with the table surface. A third step die 98 is secured to the die holder 97 in register with the third step punch 55 and has a forming surface 99 on its upper surface. After the head portion and leg portions coming from the second forming step have been cut into a single stud P by the cutting portions of the third step punch 55 as a result of downward travel of the ram 45, the stud is pressed by the third step punch 55 onto the flexible sheet material W which is held by the holder 19. The leg portions Pb of the stud P may thus pierce the material W and may then be bent inwardly by the forming surface 99 of third step die 98. The third step punch 55 and the third step die 98 constitute second plastic working means whereby the stud P coming from the first plastic working means is severed from the band steel C and mounted to the sheet material W by its leg portions Pb.

Figure 9:
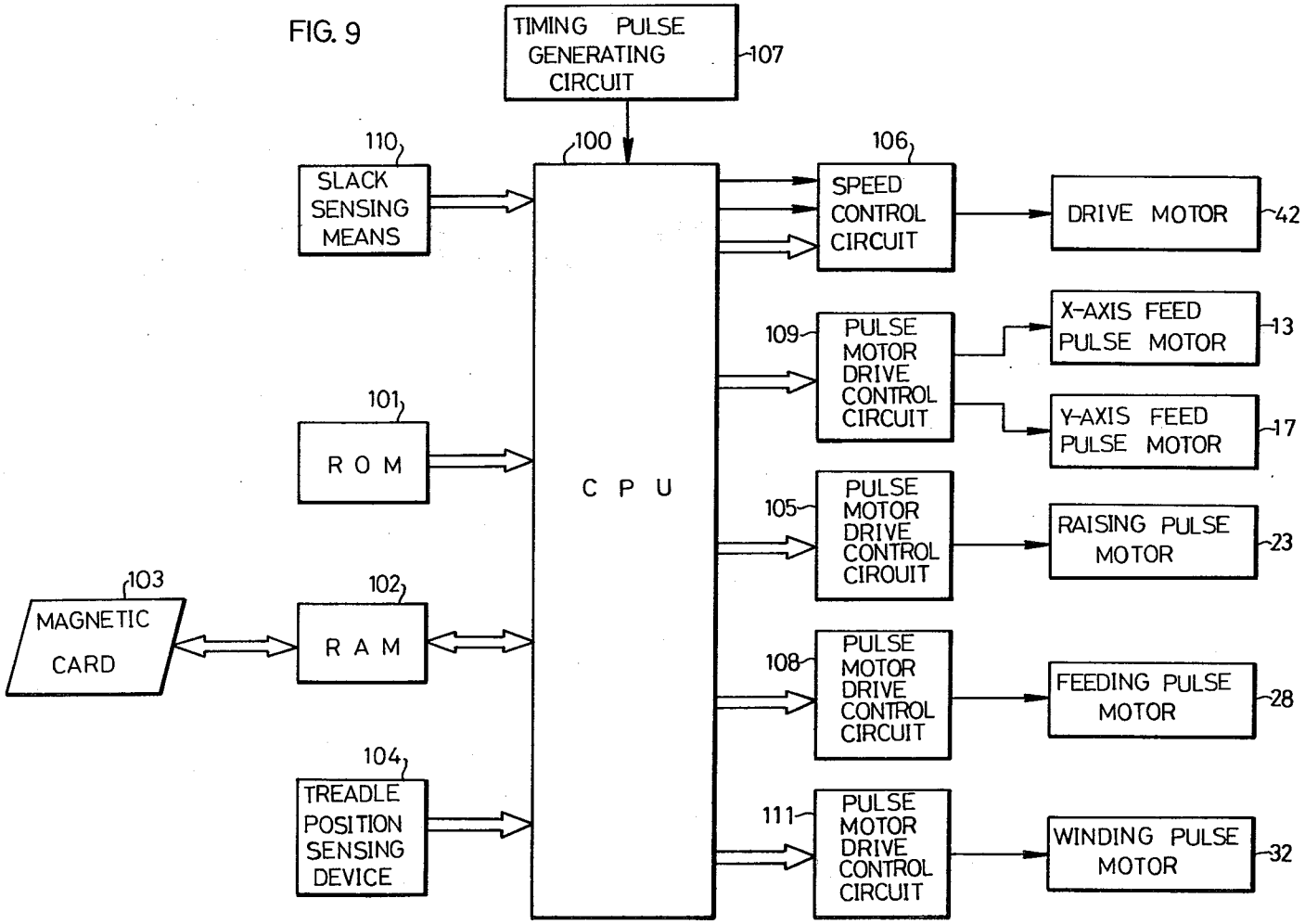

Reference is made to FIG. 9 for illustrating a control device for controlling the operation of the stud mounting device as described above.

In FIG. 9, a central processing unit (hereinafter designated CPU) 100 constitutes an operation control unit along with a programmable read only memory (hereinafter designated ROM) 101 and a random access memory (hereinafter designated RAM) 102, the latter having both the read and write functions and being used as position data storage means. Positional data for indicating the positions to which the holder 19 must be moved for mounting plural studs P to the sheet material W according to a pattern shown in FIG. 1, are recorded in advance in a magnetic card 103, and may be transferred to RAM 102 by any conventional means. A treadle position sensor 104 is interlocked with an operating treadle 8 shown in FIG. 4 for sensing the depression of the treadle 8 and is designed to transmit to CPU 100 a signal for closing the holder 19 upon small depression of the treadle 8 and a start signal upon full depression of the treadle 8. The CPU 100 operates responsive to such closure signal to transmit a closure control signal to a pulse motor drive control circuit 105 for driving the raising pulse motor, and also operates responsive to said start signal to transmit a start control signal to a speed control circuit 106 for starting the drive motor 42. The CPU 100 also receives a selection signal from a speed changeover switch (not shown) adapted for suitably selecting the rotational speed of the driver motor 42 and, based on such selection signal, transmits a speed control signal to the speed control circuit 106 for controlling the rotational speed of the drive motor 42.

A timing pulse generating circuit 107 is mounted to one side of the drive motor 42 for sensing a predetermined rotational positon of the motor 42 and outputting a timing pulse signal to the CPU 100. According to the present embodiment, the rotational position of the motor 42 corresponding to the uppermost position of the ram 45 is sensed for transmitting the timing pulse signal.

The CPU 100 operates in response to said timing pulse signals, that is, each time the ram 45 has reached its uppermost position, to transmit drive control signals to the control circuit 108 for controlling the drive of the feeding pulse motor 28 for feeding the band steel C by one pitch each time. The CPU 100 also operates in response to said timing pulse signals to sequentially read out the positional data held in RAM 102 and to output control signals to pulse motor drive control circuit 109 based on the read-out data for controlling the drive of the X-axis and Y-axis feed pulse motors 13, 17. Thus, holder 19 may be shifted in predetermined directions by the X-axis and Y-axis feed pulse motors 13, 17 based on positional data read out sequentially where the ram 45 has reached the uppermost position in the course of its vertical travel. Thus, all the positions within the rectangular frame of the holder 19 may be placed in register with the forming surface 99 of the third step die 98.

The CPU 100 transmits a stop control signal to the speed control circuit 106 for halting the drive motor 42 based on the end code of the positional data stored in RAM 102. The CPU also transmits a control signal to the control circuit 109 for driving the X-axis and Y-axis pulse motors 13, 17 for returning the holder 19 to its initial position. The CPU 100 then transmits an opening control signal to the control circuit 105 for driving the raising pulse motor 23 for opening the holder 19.

Slack sensing means 110 is constituted by an upper limit switch 33 and a lower limit switch 34 for sensing the slack of the band steel C and is designed to transmit a drive signal and a stop signal to CPU 100 on activation of the lower limit switch 34 and upper limit switch 33, respectively. The CPU 100 responds to this drive signal to transmit drive control signals to a pulse motor drive control circuit 111 to drive the winding pulse motor 32, and also responds to said stop signal to transmit a stop control signal to said control circuit 111 to stop the operation of the winding pulse motor 32. Thus, when the band steel C is slacked between the winding roll 25 and the rollers 26, 27 during its travel caused by the operation of the feeding pulse motor 28, the winding pulse motor 32 is driven in rotation by the operation of the slack sensing means 110 so that the band steel C may be kept tant at all times.

The operation of the first embodiment of the present invention will be described below. FIGS. 5, 7 show the ram 45 in its upper position and the punch plate 67 suspended above the holder 19. In this state, the stripper plate 68 is floated from the punch plate 67, the holding pins 83 are extended upwards and the band steel C is floated from the upper surface of the stripper plate 68. On the band steel C, a formed portion of the first step, that is, a head portion Pa resulting from the preceding forming operation effected between the first step die 53 and the first step punch 89, is positioned between the second step die 54 and the second step punch 90, whereas a formed portion of the second step, that is, the head portion Pa and leg portions Pb resulting from the preceding forming operation effected between the second step die 54 and the second step punch 90, is positioned between the third step die 98 and the third step punch 59.

In this state, when the treadle 8 is depressed incompletely, the drive motor 42 is started for initiating the downward travel of the ram 45 along with the punch plate 67 and the stripper plate 68. When the punch plate 67 has come to a position slightly above the holder 19, the stoppers 72 of the first guide rods 69 about on the extending portion 70 of the head 5 of the stud attaching apparatus 4, so that downward travel of the punch plate 67 is first terminated.

As the ram 45 contines its downward stroke, the third step punch 55 abuts on the head portion Pa of the formed portion of the second step for pressing down, said formed portion while the outer peripheral cutting portions of the third step punch 55 severs the formed portions of the second step from the band steel C. Thereafter, the inner die 58 of the first step die 53 abuts on band steel C, and the inner die 59 of the second step die 54 abuts on a head portion Pa of the formed portion of the second step, whilst the cutting portions 62 on the outer die 57 of the second step die 54 abuts on four portions of the band steel C radially outwardly of the head portion Pa.

As the ram 45 contines its downward travel, the band steel C, supported by pins 83 in the floated position from the stripper plate 68, is depressed and abuts on the upper surface of the stripper plate 68 against the action of the springs 88 on the holding pins 83. After the band steel C has thus abutted on the upper surface of stripper plate 68, the plate 68 is pressed down and abuts on the upper surface of punch plate 67 against the action of the springs 77.

The holding pins 83 are pressed down by presser screws 66, as shown in FIG. 6, so that the band steel C is now pressed strongly on the upper surface of the stripper plate 68 and held there stationarily. In this state, the drawing of head portion Pa by the first step die 53 and first step punch 89 and the cutting and forming of the leg portions Pb and subsequent bending thereof by the second step die 54 and the second step punch 90 take place simultaneously. As a concurrent operation, the stud P severed by the third step punch 55 during the downward stroke of the ram 45 is pressed to the sheet material W by the third step punch 55 so that the leg portions Pb will pierce the sheet material W and then will be then bent inwardly by the forming surface 99 of the third step die 98 on the reverse side of the sheet material W. The stud P may thus be mounted on the sheet material W.

With the stud P thus mounted in position, the ram 45 is returned upwards and the band steel C, the stripper plate 68 and the punch plate 67 are returned upwards in a reverse sequence to that described above.

Figure 4:
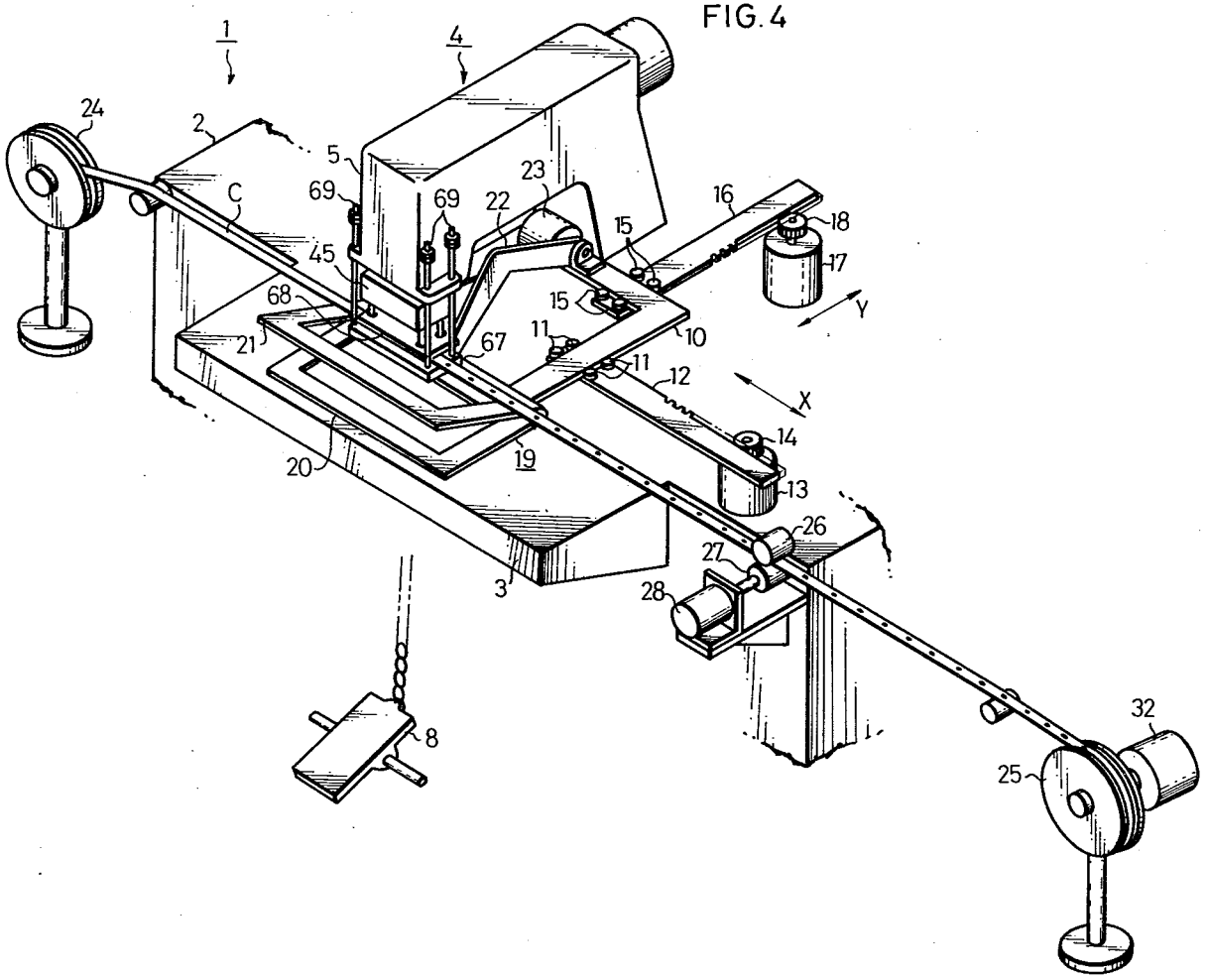

When the first and second step dies 53, 54 and the first, second and third step punches 89, 90, 55 have cleared the band steel C, the ram 45 has reached its uppermost position and a timing pulse signal has been supplied from the circuit 107, the feeding pulse motor 28 is subjected to the rotation of a predetermined angle, so that the band steel C is fed by cooperation between the rollers 26, 27 by one pitch to the next working position and towards right in FIGS. 4 through 6. Thus, as shown in FIG. 5, the formed portions of the first and second steps are positioned between the die 54 and the punch 90 and between the die 55 and the punch 98, respectively. The band steel C is taken up on the winding roll 25 by a length equal to one pitch because the winding pulse motor 32 is driven by the driving signal from slack sensing means 110.

The mounting of a stud P of one cycle is now completed.

Figure 2:
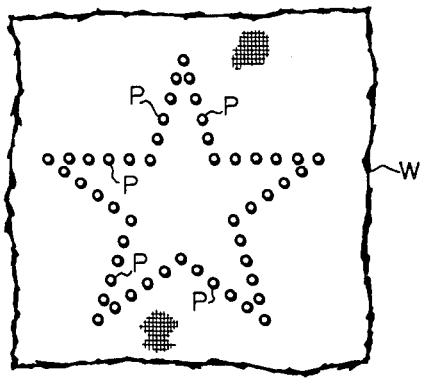
Figure 3:
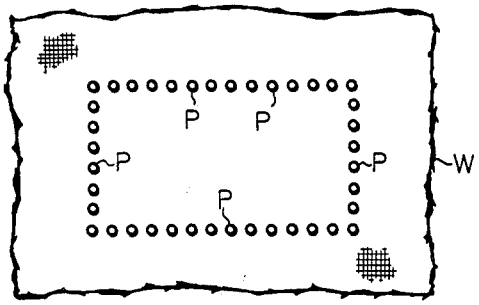

With completion of one stud mounting operation, that is, with each timing pulse signal, the CPU 100 reads out the next positional data and, based on these data, transmits a control signal to the pulse motor drive control circuit 109 for shifting the holder 19 to the next operating position. The X-axis and Y-axis pulse feed motors 13, 17 may thus be controlled in rotation by said control signal whereby the holder 19 may be shifted to the next working position transversely, longitudinally or in combined directions along with sheet material W through the medium of the gears 14, 18, racks 12, 16 and movable member 10. As the positional data stored in RAM 102 are read out sequentially and the operation similar to that described above is repeatedly made on the basis of these read-out data, a number of studs P may be mounted on the sheet material W according to any desired pattern as shown exemplarily in FIGS. 1 through 3.

Upon completion of the predetermined stud pattern based on the positional data stored on RAM 102, CPU 100 transmits a stop control signal to the speed control circuit 106 based on end code of the positional data. The drive motor 42 is halted by the stop control signal from CPU 100 so that the ram 45 is stopped at the upper limit position. The X-axis and Y-axis feed pulse motors 13, 17 are controlled for restoring the holder 19 to its initial position. Then, the raising pulse motor 23 is driven for pivoting the arm 22 and pivoting the presser plate 21 of the holder 19 in the opening direction. The sheet material W, thus provided with stud pattern, may now be taken out from the device.

SECOND EMBODIMENT

Reference is made to FIGS. 16 through 26 for illustrating a second embodiment of the present invention. A table 203 is mounted as an extension of a front portion of a bed 202 of a frame 201. A die supporting arm 204 is fixedly mounted to the upper surface of the bed 202.

Figure 16:
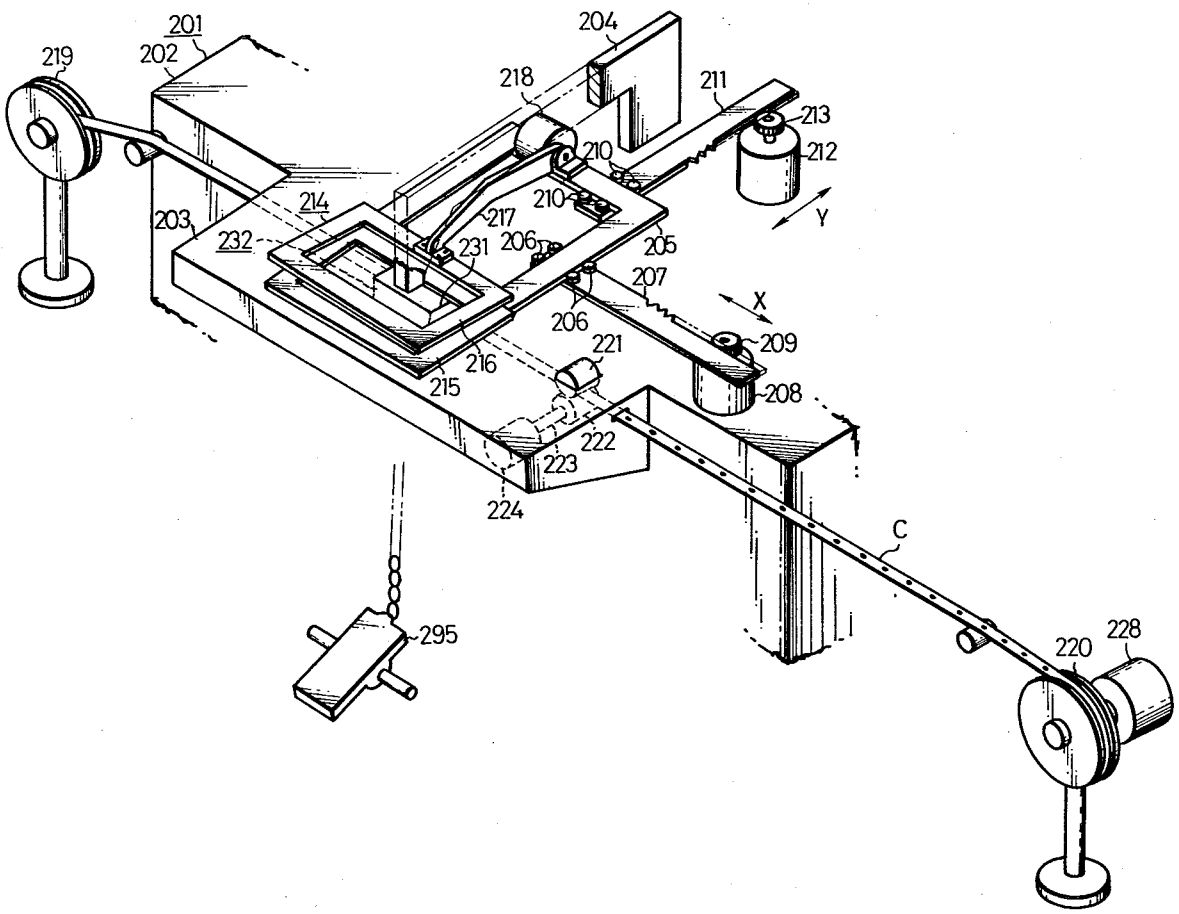

A movable member 205 is mounted on the upper surface of the bed 202 for movement along X-axis or transversely and along Y-axis or longitudinally as indicated in FIG. 16. An X-axis rack 207 has four end rollers 206 holding the longitudinal side of the movable member 205 and meshes with a gear 209 mounted on an output shaft of an X-axis feed pulse motor 208, so that forward and reverse rotation of the motor 208 results in X-axis feed movement of the movable member 205. Similarly, a Y-axis rack 211 has four end rollers 210 holding the transverse side of the movable frame 205 and meshes with a gear 213 secured to an output shaft of a Y-axis feed pulse motor 212 so that forward and reverse rotation of the motor 212 results in Y-axis feed movement of the movement member 205.

Above said table 203, there is mounted a holder 214 to the foremost part of the movable member 205 so as to be positioned below the foremost part of the die supporting arm 204 and be movable along X and Y axes together with the movable member 205. The movable member 205, racks 207, 211 and both pulse motors 208, 212 constitute drive means for varying the position of holder 214 in the X and Y directions. The holder 214 consists of a supporting base plate 215 in the form of a rectangular frame and a presser plate 216 in the form of a rectangular frame designed for opening and closing relative to the upper surface of the base plate 215, so that flexible sheet material W such as fabric or leather may be damped between the plates 215 and 216. The presser plate 216 is biased by a spring (not shown) in a direction to clamp the sheet material between it and the base plate 215. An arm 217 is pivotally mounted to the rear side of the movable member 205 and has its end portion connected to the presser plate 216. Rotation of a raising pulse motor 218 mounted laterally of the arm 217 causes the arm 217 to be swung about its fulcrum for pivoting the presser plate 216 in the opening direction.

A supplying roll 219 and a winding roll 220 are mounted to the left and right sides of the bed 202, respectively, so that a band steel C placed on the supplying roll 219 may travel below the holder 214 and be taken up on the winding roll 220.

Figure 22:
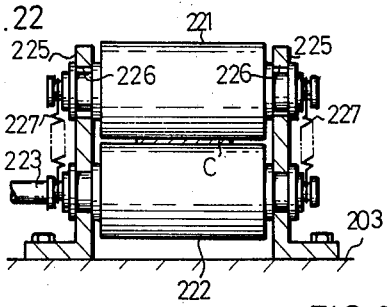

Towards said winding roll 220, there are mounted on the table 203 a rubber presser roller 221 and a rubber driving roller 222 for clamping said band steel C as metal strip, from above and below. A feeding pulse motor 224 has its output shaft operatively connected to the driving roller 222, so that rotation of the motor 224 by predetermined increments causes intermittent transfer of the band steel C towards the winding roll 220 by predetermined amounts. As shown in FIG. 22, the presser roller 221 and the driving roller 222 are supported between a pair of supporting plates 225, each of which has a vertically oblong supporting bore 226, for supporting the presser roller 221, to allow for small vertical movement of the roller 221. The presser roller 221 is biased by a spring 227 in a direction to clamp the band steel C between it and the driving roller 222. The winding roll 220 is rotated stepwise by predetermined desirable increments by operation of winding pulse motor 228. The winding pulse motor 219, winding roller 220, winding pulse motor 228, feeding pulse motor 224, presser roller 221 and the driving roller 222 constitute feed means for feeding the band steel C through a space above the flexible sheet material W which is held by the holder 214.

Figure 23:
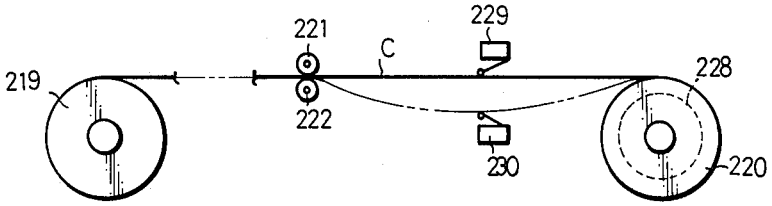

As shown in FIG. 23, on the transfer path between the winding roll 220 and the rollers 221, 222, there are mounted an upper limit switch 229 and a lower limit switch 230 above and below the band steel C, respectively.

The lower limit switch 230 may be activated when the band steel C has sagged for causing rotation of the winding pulse motor 228 and hence rotation of the winding roll in the winding direction. The upper limit switch 229 may be activated when the band steel C has become taut as a result of winding thereof for terminating the rotation of the winding pulse motor 228 and hence the winding of the band steel C.

Figure 24:
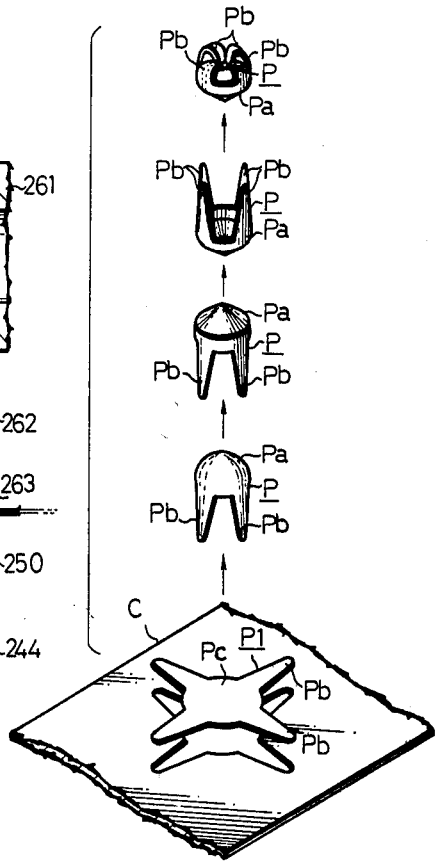

During transfer from the supplying roll 219 towards the winding roll 220, the band steel C is subjected to blanking as shown in FIG. 24 so that a stud element P1 consisting of a center portion Pc and four leg portions Pb around the portion Pc is punched. The stud element P1 is then subjected to drawing so that said center portion Pc is turned into a cap-like semispherical head portion Pa and the leg portions Pb are similarly oriented. The resulting stud P is then subjected to forming so that the center portion Pa has a pointed end, then turned upside down, and the leg portions Pb are pierced through the sheet material and bent inwardly for mounting the stud to the sheet material. The device for effecting such operation will be described below.

Figure 17:
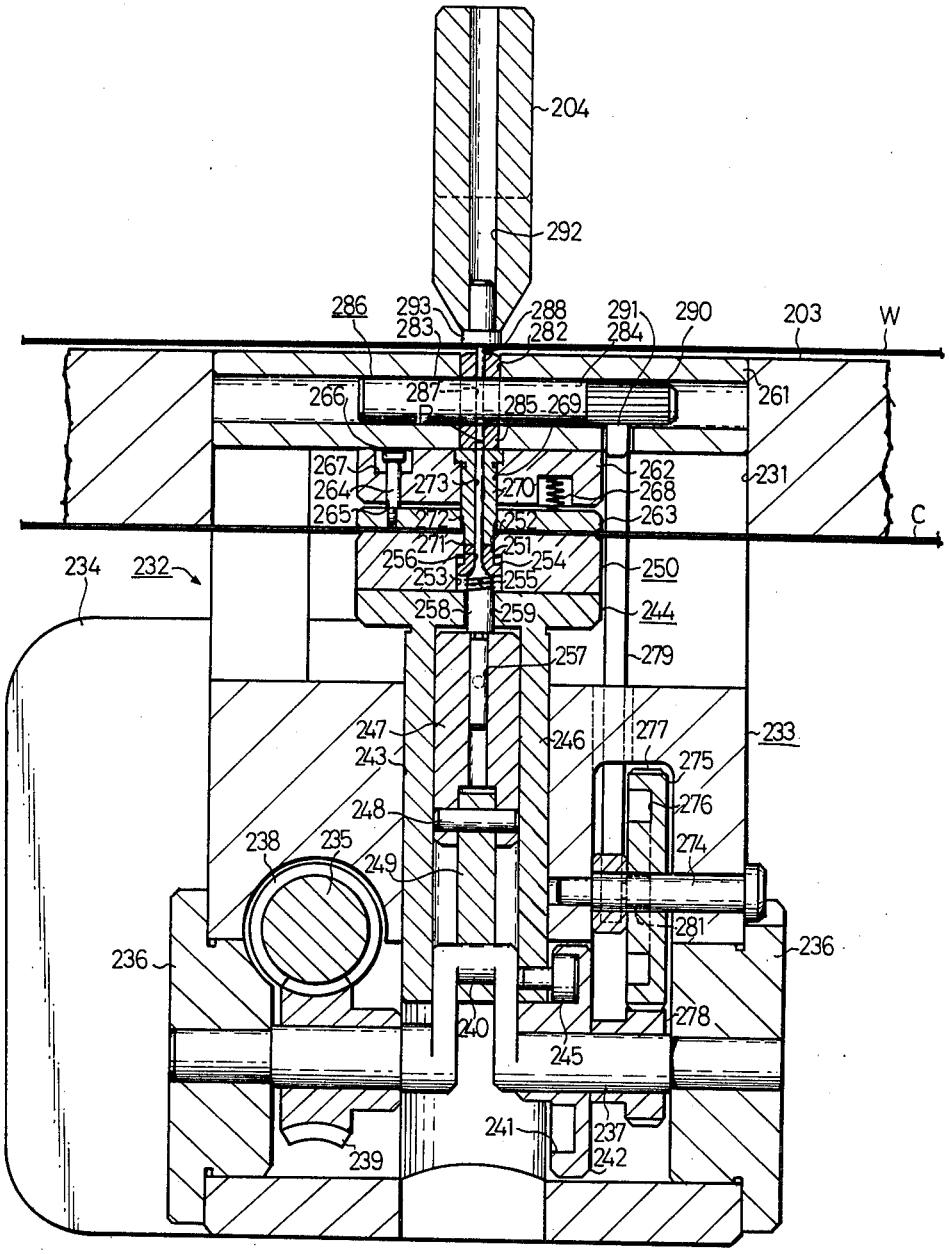
Figure 18:
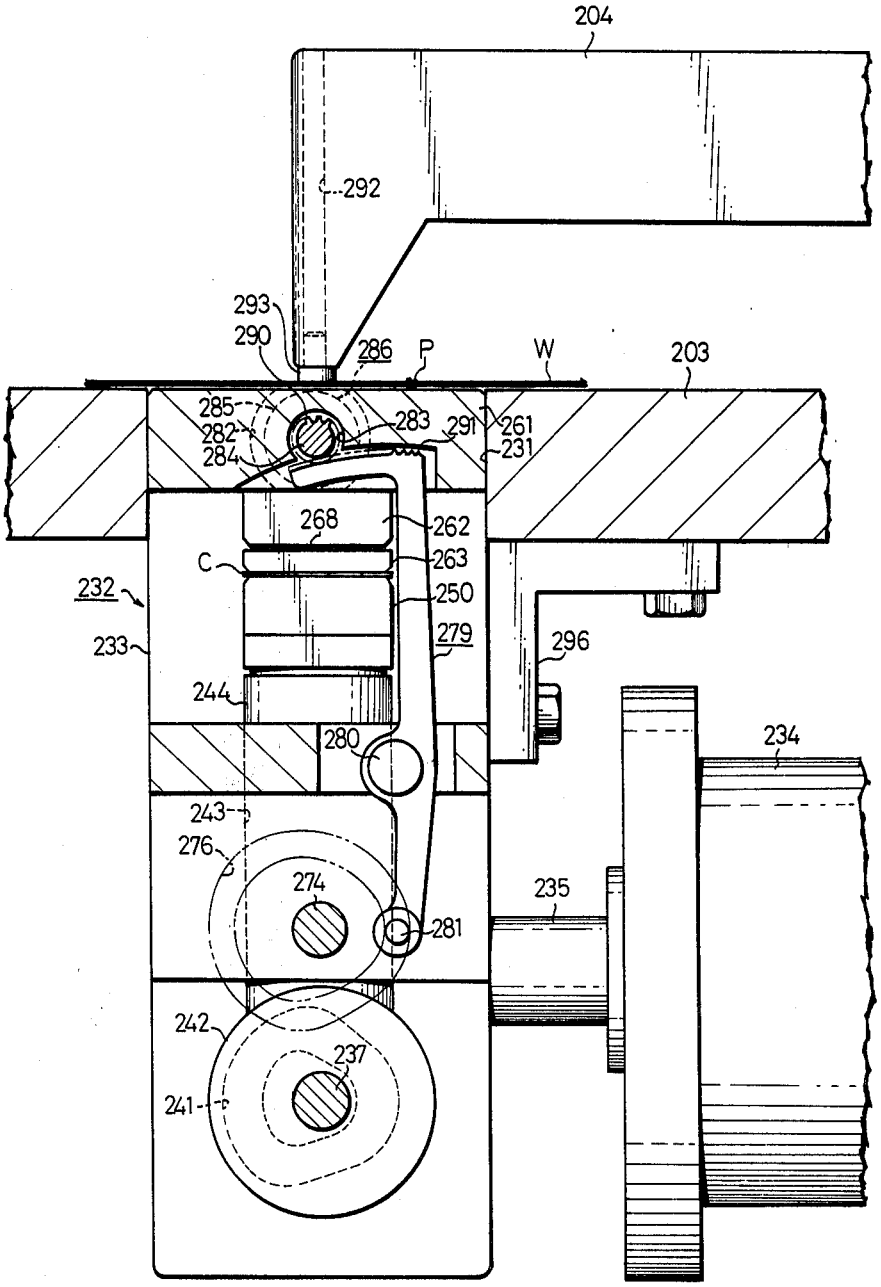

As shown in FIGS. 17 and 18, a stud attaching unit 232 is fitted into a through attaching opening 231 provided in about the center of the table 203 and is secured to the table 203 by the medium of an attaching plate 296 so that the upper surface of a frame 233 thereof is flush with the upper surface of the table 203. A motor shaft 235 of a d.c. driving motor 234, secured to the lower surface of the table 203 (see FIGS. 17, 18), is extended into the lower inner region of the frame 233. Below motor shaft 235, a drive shaft 237 in the form of a crank shaft is rotatably mounted to the frame 233 by way of bearing 236 and connected to motor shaft 235 through a worm 238 and a worm wheel 239. The mid portion of the drive shaft 237 has a crank 240. In the vicinity of the crank 240, a first cam member 242 having a cam groove 241 is secured to the drive shaft 237.

The lower portion of the frame 233 is formed with a guide bore 243 into which an outer ram 244 is mounted vertically movably and has at the lower end a cam follower 245 which in turn is inserted into a cam groove 241 of the first cam member 242. As may be seen from FIG. 26, with rotation of drive shaft 237, the outer ram 244 may be reciprocated vertically within a predetermined range by operation of the cam groove 241. In a lower cylindrical portion 246 of the outer ram 244, an inner ram 247 is mounted vertically movably and carries at the lower portion a connecting shaft 248, and a connecting link 249 is interposed between the shaft 248 and the crank 240. The arrangement is so made that, with rotation of drive shaft 237, the inner ram 247 may be reciprocated vertically within a predetermined range (see FIG. 26).

A die plate 250 is attached to the upper surface of outer ram 244 and has a blanking bore 251 opened on its upper surface. The bore 251 has the same plan contour as the stud element Pl and has the upper opening edge designed as cutting portion 252. A bore 253 is formed below and in communication with blanking bore 251.

A holding block 254 having its upper portion inserted into the blanking bore 251 is accommodated in the bore 253 for vertical movement and normally biased upwards by a spring 255. The holding block 254 has a central bore 256 which is taperedly enlarged at the lower end portion.

The inner ram 247 has a bore 257 in which a drawing punch 258 is inserted and secured at the lower end extremity and, with elevation of the inner ram 247, may be extended upwards through a bore 259 in the outer ram 244 and the bore 256 in the holding block 254. The upper end extremity of the drawing punch 258 is formed with a small diameter portion 260 (see FIGS. 19 through 21).

Figure 20:
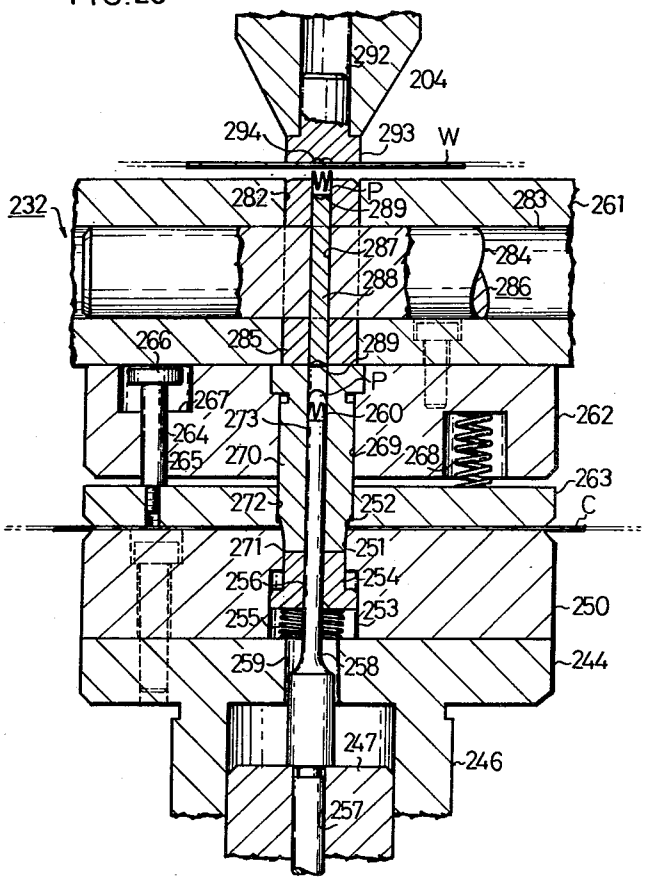
Figure 19:
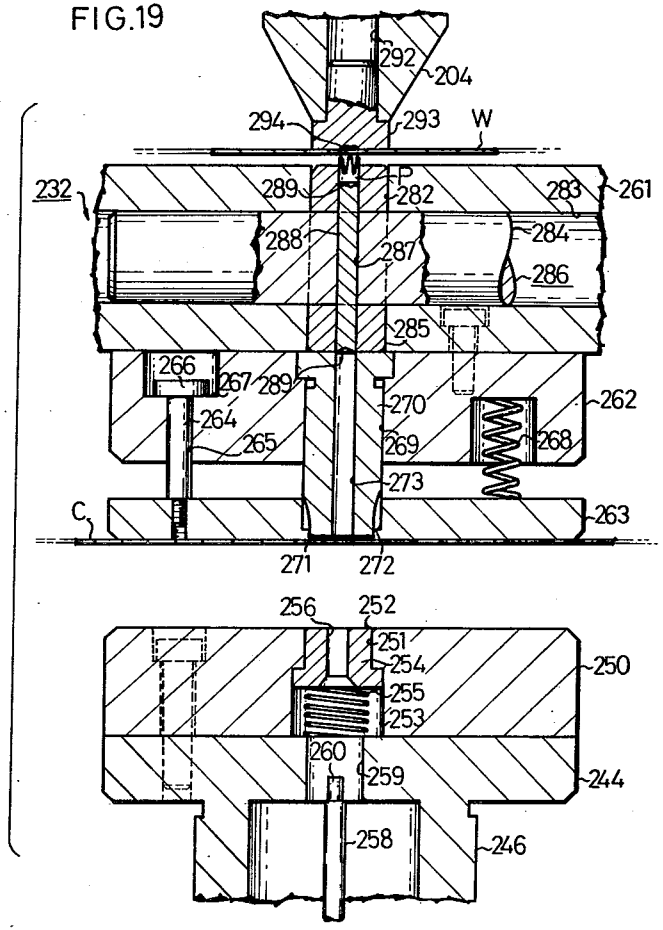
Figure 21:
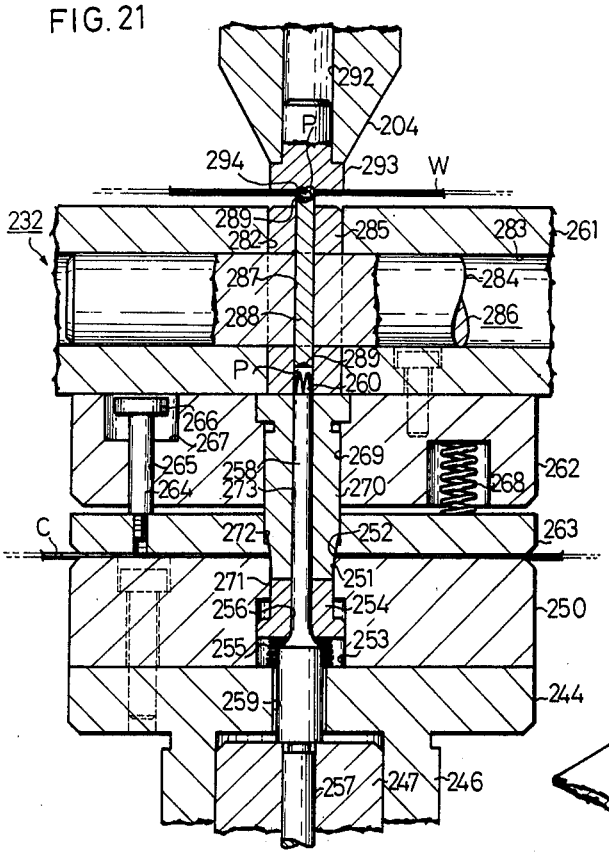

A punch plate 262 is attached to the lower surface of an upper block portion 261 which is provided to the upper extremity of the frame 233, and a stripper plate 263 is mounted below the punch plate 262. The band steel C travels between the stripper plate 263 and the die plate 250. A plurality of guide pins 264 are mounted upright on the upper surface of the stripper plate 263 and guide bores 265 are formed through punch plate 262 for accommodating these guide pins 264. As shown in FIG. 19, stripper plate 263 may be suspended by engagement of head portions 266 of guide pins 264 with stopper surfaces 267 in the guide bores 265. Springs 268 are interposed between the punch plate 262 and the stopper plate 263 for downwardly biasing the stripper plate 263. The arrangement is so made that, when the outer ram 244 is lowered as shown in FIG. 19, the die plate 250 secured to the upper surface of the outer ram 244 is separated from the stripper plate 263 and the plate 263 is suspended from the punch plate 262, and that, when the outer ram 244 has been raised as shown in FIGS. 20 and 21, the band steel C is clamped between die plate 250 and stripper plate 263 and the plate 263 is uplifted against the action of springs 268.

A blanking punch 270 is inserted into and secured to a central bore 269 in the punch plate 262 and has the outer lower peripheral edge formed as cutting portions 271 having the same contour as stud element P1. The stripper plate 263 has a bore 272 for passage of the lower portion of the blanking punch 270. The blanking punch 270 has a central drawing bore 273. The arrangement is so made that, as the stripper plate 263 is raised with upward travel of the outer ram 244, as shown in FIGS. 20, 21, the lower extremity of the blanking punch 270 enters the blanking bore 251 from above, the band steel C is subjected to blanking through cooperation of the cutting portions 252, 271 for punching a stud element P1, and the stud element P1 thus punched is held between the blanking punch 270 and the holding block 254. In this state, as the inner ram 247 is raised, the drawing punch 258 is raised through the drawing bore 273, while the stud element P1 thus held is carried by the upper small diameter portion 260, so that the element Pl is formed into a stud P having the rounded cap-like head portion Pa.

The die plate 250 having the blanking bore 251 and the blanking punch 270 constitute blanking means for punching stud elements P1 from band steel C. The drawing punch 258 and the blanking punch 270 having the drawing bore 273 constitute drawing means for forming the stud elements P1, the blanking punch 270 then serving as drawing die. The blanking means and the drawing means constitute plastic working means.

As shown in FIGS. 17, 18, in the lower portion of the frame 233, a second cam member 275 is rotatably supported by a shaft 274 and has on one lateral surface a cam groove 276. The second cam member 275 has on the outer periphery a gear 277 meshing with a gear 278 secured to drive shaft 237 so that the second cam member 275 is rotated with rotation of drive shaft 237. In the neighborhood of the second cam member 275, an operating lever 279 is rotatably supported by a shaft 280 and has at a lower end thereof a cam follower 281 which is inserted into cam groove 276 so that, with rotation of the second cam member 275, the operating lever 279 may be swung reciprocably within a predetermined range by the camming operation of the cam groove 276.

The upper block portion 261 has a space 282 which is circular when viewed laterally and a supporting bore 283 extending to both sides of the space 282. A rotary member 286, consisting of a rotary shaft 284 and a rotary disk 285 fitted and secured centrally about the outer peripheral surface of the rotary shaft 284, is supported in the supporting bore 283 by the rotary shaft 284 for rotation about an axis perpendicular to the axis of reciprocating movement of the drawing punch 258. The rotary disk 285 is accommodated in the space 282. A bore 287 is formed on the diametral line of the disk 285 and, when the rotary member 286 has been rotated to a predetermined rotary position, the bore 287 may communicate with the drawing bore 273 on the axis of reciprocating movement of the drawing punch 258. A stud attaching punch 288 is mounted in the bore 287 for the reciprocating movement and, as shown in FIGS. 19 and 20, has forming surfaces 289 at the ends for providing pointed ends to the head portion Pa of the stud P. When the drawing punch 258 has arrived at its upper end position, the stud P held at the upper end of the drawing punch 258 is received into the lower end of bore 287 and has its upper portion formed into pointed shape, the stud attaching punch 288 being raised and extended above the bore 287. As the punch 288 is raised, the stud P, retained at the upper portion of the bore 287, pierces through the sheet material W at the leg portions Pb. The stud Pb is retained at both end portions of the bore 287 due to the leg portions tending to be spread out by resiliency.

The one end portion of the rotary member 286 has a gear 290 meshing with a gear 291 on the upper extremity of the operating lever 279. The arrangement is so made that the lever 279 is swung in towards fore or aft sides each time the drawing punch 258 is separated from rotary member 286 and thus the rotary member 286 is turned by steps of 180° so that the upper and lower ends of the bore 287 may alternately face to the drawing bore 273 and the sheet material (see FIG. 26). Thus the rotary member 286 constitutes reversing means for reversing the stud P so that its leg portions Pb may be directed to the sheet material W. The second cam member 275 having the cam groove 276 and the operating lever 279 constitute rotary means for rotating the rotary member 286 by 180 degrees each time the drawing punch 258 clears the member 286 so that the end of the bore 287 faces to the drawing punch 258.

The fore portion of the die supporting arm 204 has a vertical bore 292 to the lower end of which is fitted and secured the stud attaching die 293 which overlies the sheet material W. The stud attaching die 293 has a forming surface 294 on its lower surface so that the leg portions Pb which have pierced through the sheet material W with upward travel of the punch 288 may be bent inwardly by operation of the forming surface 294. The stud attaching die 293 and the stud attaching punch 288 constitute plastic working means, distinct from that described above, for bending the leg portions Pb of the stud P.

Figure 25:
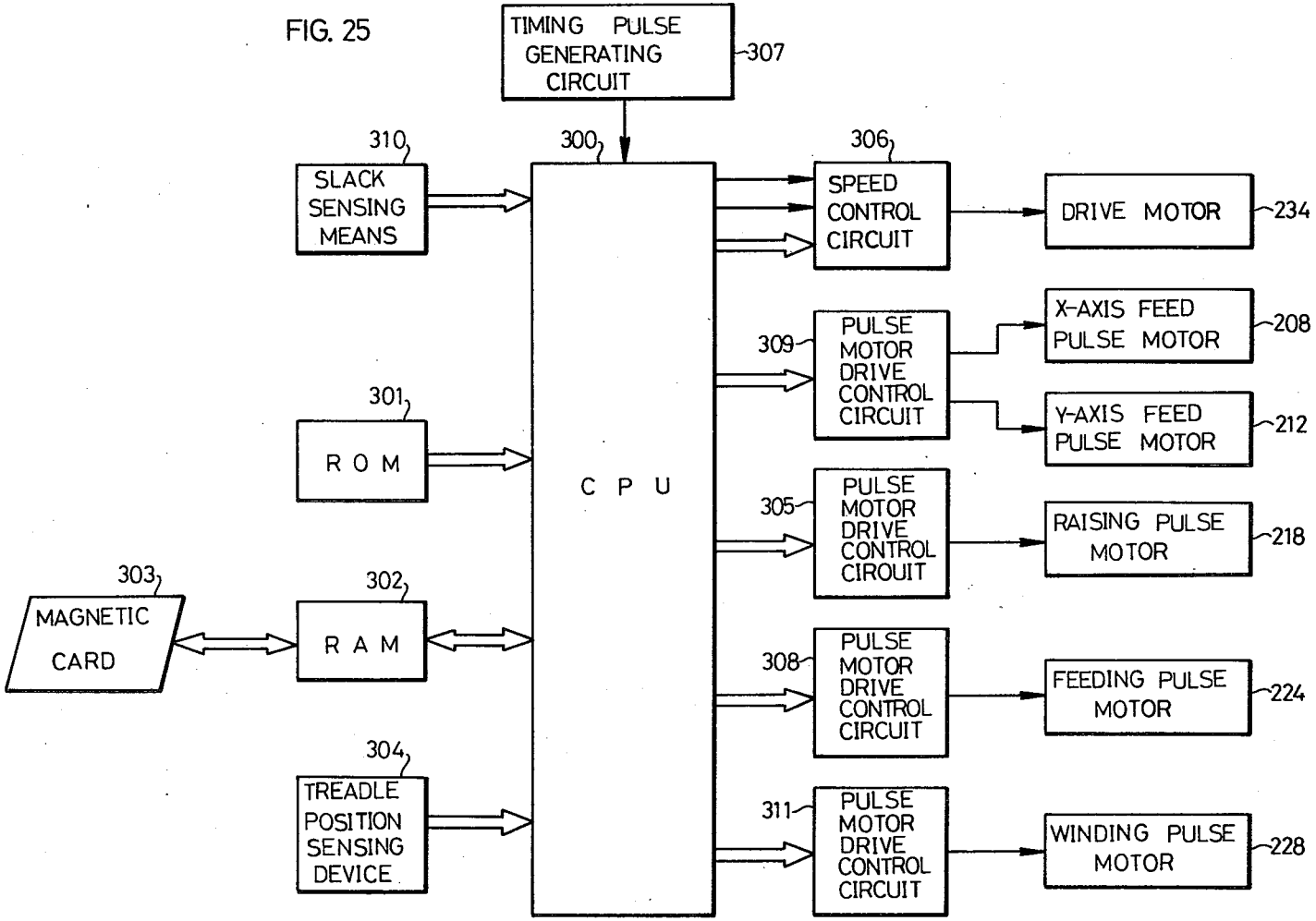
Figure 26:
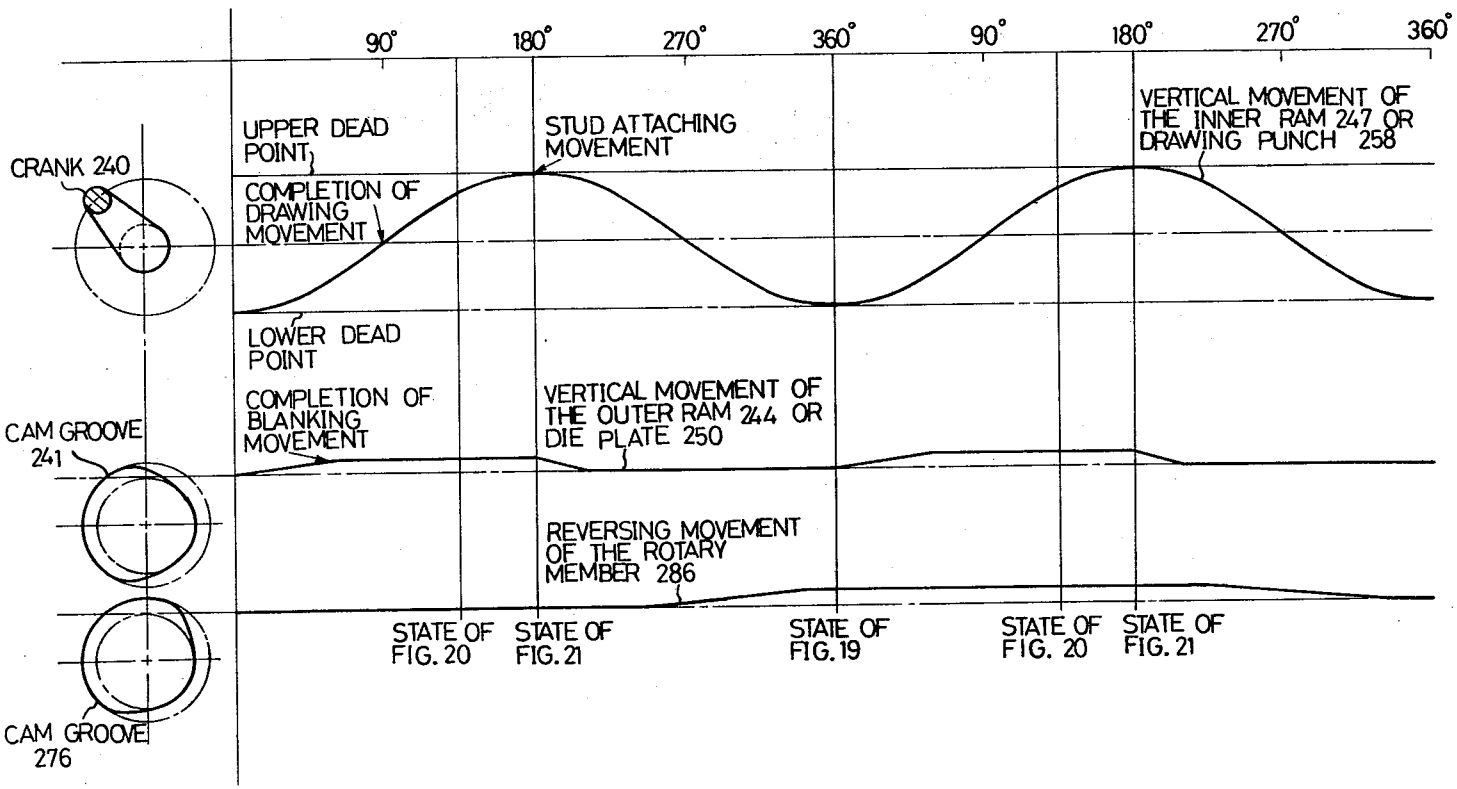

Reference is made to FIG. 25 for illustrating a control device for controlling the operation of the stud mounting device.

In FIG. 25, a central processing unit (hereinafter designated CPU) 300 constitutes an operation control unit along with a programmable read only memory (hereinafter designated ROM) 301 and a random access memory (hereinafter designated RAM) 302, the latter having both the read and write functions and being used as position data storage means. Position data for indicating the positions to which the holder 214 must be moved for mounting plural studs to the sheet material W according to a desired pattern such as one shown in FIG. 1 are recorded in advance in a magnetic card 303 and may be transferred to RAM 302 by any conventional means. A position sensor 304 is interlocked with a treadle 295 shown in FIG. 16 for sensing the treadle depression and is designed to transmit to CPU 300 a signal for closing the holder 214 upon small treadle depression and a start signal upon full treadle depression. The CPU 300 operates in response to such closure signal to output a closure control signal to a pulse motor drive control circuit 305 to deenergize the motor 218 to permit the presser plate 216 to be closed to the base plate by spring action. The CPU also supplies a start control signal to a speed control circuit 306 responsive to said start signal for starting the drive motor 234. The CPU 300 also receives a selection signal from a speed changeover switch (not shown) adapted for suitably selecting the rotational speed of the drive motor 234 and, based on such selection signal, transmits a speed control signal to the speed control circuit 306 for controlling the rotational speed of the drive motor 234.

A timing pulse generating circuit 307 is mounted to one side of the drive motor 234 for sensing a predetermined rotary position of the motor 234 and outputting a timing pulse signal to CPU 300. According to the present embodiment, the rotary position of the motor 234 corresponding to the lowermost position of the outer ram 244 is sensed for transmitting the timing pulse signal.

The CPU 300 operates in response to such time pulse signals, that is, each time the ram 244 has reached the lowermost position, to transmit drive control signals to the control circuit 308 for controlling the drive of the feeding pulse motor 224 to feed the band steel C by one pitch. The CPU 300 also operates in response to said timing pulse signals to sequentially read out the position data stored in RAM 302 and to deliver control signals to pulse motor drive control circuit 309 based on the read-out data so as to control the drive of the X-axis and Y-axis feed pulse motors 208, 212. Thus the holder 241 may be shifted by the X-axis and Y-axis feed pulse motors 208, 212 in predetermined directions based on positional data read out when the outer ram 244 has reached the lower limit of its travel stroke. Thus, all the positions within the rectangular frame of the holder 214 may be placed in register with the forming surface 294 of the stud attaching die 293.

The CPU 300 transmits a stop control signal to the speed control circuit 306 for stopping the drive motor 234 based on the end code of the position data stored in RAM 302, and a control signal to the motor drive control circuit 309 for driving the X-axis and Y-axis pulse motors 208, 212 for restoring the holder 214 to its initial position. The CPU 300 then transmits an opening control signal to the control circuit 305 for driving the raising pulse motor 218 for opening the holder 214.

Slack sensing means 310 is composed of an upper limit switch 329 and a lower limit switch 230 for sensing the slack of band steel C and is designed to transmit a drive signal and a stop signal to CPU 300 on activation of the lower and upper limit switches 230, 229, respectively. The CPU 300 responds to this drive signal to transmit drive control signals to a pulse motor drive control circuit 311 to drive the winding pulse motor 228 and also responds to said stop signal to transmit a stop control signal to said circuit 311 to stop the operation of the winding pulse motor 228. Thus, when the band steel C is slacked between the winding roll 220 and the rollers 221, 222 during its travel caused by operation of the feeding pulse motor 224, the winding pulse motor 228 is driven in rotation by the operation of the slack sensing means 310, so that the band steel C may be kept taut at all times.

The CPU 300, RAM 302 and the pulse motor drive control circuits 308, 309 constitute control means whereby the X-axis and Y-axis feed pulse motors 208, 212 may be activated for shifting the holder 214 to the next stud mounting position and the feeding pulse motor 224 may be activated for advancing the band steel C to the next working position during the time that the stud attaching punch 288 and the stud attaching die 293 and separated from one another.

The operation of the second embodiment as described above will be explained by referring to FIG. 26 illustrating the operational sequence of the device. In FIG. 19, the outer ram 244 and the inner ram 247 have been shifted to the lower stroke ends and the die plate 250 is separated from the stripper plate 263 which is now suspended from the punch plate 262. In this state, the drawing punch 258 is positioned below the bore 253 of the die plate 250, the cutting portions 271 on the lower extremity of the stripper plate 270 are positioned in the bore 272 of the stripper plate 263, the bore 287 of the rotary member 286 faces to the drawing bore 273, and the stud P formed in the preceding step is retained at the upper end of the rotary member 286 so that the leg portions Pb are directed upwards.

When the treadle 295 shown in FIG. 16 is depressed initially in this state, the drive motor 234 is started and the drive shaft 237 is thereby driven into revolution. The first cam member 242 is thereby driven in rotation and the outer ram 244 starts to be raised by operation of the cam groove 241, while the inner ram 247 also starts to be raised by operation of the crank 240. As the outer ram 244 is raised, the band steel C is clamped between the die plate 250 and stripper plate 263 and the stripper plate 263 is then raised to the position shown in FIG. 20. Thus the cutting portions 271 of the blanking punch 270 are extended downward from the bore 272 and, through cooperation of the cutting portions 271 with the blanking bore 251 in the die plate 250, a stud element P1, consisting of a center portion Pc and leg portions Pb as shown in FIG. 24, is punched and transiently retained between the blanking punch 270 and the holding block 254. In this state, the upward travel of the outer ram 244 is terminated. It is to be noted that, with rotation of the drive shaft 237 caused by initial incomplete depression of the treadle 295, the second cam member 275 is driven in rotation through gears 277, 278, but the cam groove 276 of the second cam member 275 is not effective at this stage.

During upward travel of the inner ram 247, which is retarded to some extent with respect to that of the outer ram 244, the drawing punch 258 secured to the inner ram 247 is raised through the drawing bore 273 of the blanking punch 270.

Thus the stud element P1, retained between the blanking punch 270 and the holding block 254, is raised by the drawing punch 258, and formed into stud P by being worked between the upper small diameter portion 260 of the drawing punch 258 and the inner periphery of the drawing bore 273. Thereafter, the stud attaching punch 288 in the bore 287 is acted upon and raised by drawing punch 258 by the intermediary of the stud P fitted to the small diameter portion 260, as shown in FIG. 21. The head portion Pa of the stud P fitted on the small diameter portion 260 is worked in this way into a pointed shape, at the same time that the stud P produced in the preceding step and held in the upper portion of the bore 288 with the leg portions upwards, now pierces through the sheet material W with the leg portions Pb which are then bent inwards upon contact with the forming surface 294 of the stud attaching die 293. The attaching operation of one stud is now completed and the upward travel of the drawing punch 258 ceases.

The outer ram 244 and the inner ram 247 are then shifted down by the reverse sequence to that described above. Thus, die plate 250 is moved away from the stripper plate 263 and the drawing punch 258 is moved out of the bore 287, drawing bore 273 and the bore 256 of the holder block 254 in this order. After the drawing punch 258 has been shifted out of bore 287, the stud P is left in the bore 287, because the stud P tends to be spread apart resiliently and to frictionally abut on the wall of the bore. On the other hand, once the punch 258 is shifted out of the bore 287, the operating lever 279 is swung in the fore or aft direction, by the operation of the cam groove 276 of the second cam member 275, and the rotary member 286 is now turned by 180 degrees. The bore 287 is now reversed and the stud P, so far retained in the lower portion of the bore 287, is brought to a position facing to the sheet material W with the leg portion Pb pointing upwards, the stud attaching unit 232 being returned to the position shown in FIG. 19. It is to be noted the upper end of the stud attaching punch 288 is protruded slightly from the upper end of the bore 287 during the time that the stud P is mounted to the sheet material, but the protruding portion is abutted by the upper surface of the blanking punch 270 during reverse rotation of the rotary member 286 and thus may be receded into the bore 287.

When the outer ram 244 and the ram 247 have returned to their lower positions, a timing pulse signal is outputted from pulse signal generating circuit 307 and the feeding pulse motor 224 is rotated by a predetermined angle. Thus the band steel C is advanced by one pitch towards right in FIGS. 19 to 21 through cooperation between presser roller 221 and drive roller 222 and arrives at the next working position wherein a new unblanked portion of the band steel C is located in position between the blanking punch 270 and the blanking bore 251. The slack caused by the feeding of the band steel C by one pitch is sensed by slack sensing means 310 which then issues a driving signal for driving the winding pulse motor 228 so as to wind the band steel on drum 20 to take up the slack.

The mounting of one stud is now completed.

Each time the mounting of one stud is completed, and hence, each time one timing pulse signal is issued, CPU 300 reads out the next positional data and issues a control signal to the pulse motor drive control circuit 309 for positioning the holder 214 at the next position indicated by such data. The X-axis and Y-axis feed pulse motor 212 are now activated on the basis of such control signal and the holder 214, holding the sheet material W, is shifted to the next working position transversely, longitudinally or in any combined direction through the medium of gears 209, 213, racks 207, 211 and movable member 205. Thus, as the above operation is repeatedly performed on the basis of the positional data sequentially read out from RAM 302, a number of studs P may be attached to the sheet material W according to a desired pattern as shown by way of example in FIGS. 1 through 3.

Upon completion of the stud pattern formation based on the positional data stored in RAM 302, the CPU 300 issues a stop control signal to the speed control circuit 306 based on the end code of the positional data. The drive motor 234 is thereby halted and the outer and inner rams 244, 247 are halted in their lowermost positions. The holder 214 is returned to its initial position by controlled operation of the X-axis and Y-axis feed pulse motors 208, 212, and the arm 217 is swung by controlled operation of the raising pulse motor 218 for swinging the presser plate 216 of the holder 214 in the opening direction. The sheet material W to which the studs have been attached in the desired pattern, may now be taken out from the apparatus.

The present invention is not limited to the above embodiments, but many other modifications are possible without departing from the spirit and scope of the invention. Thus, in the above two embodiments, studs are punched from the metal strip and supplied to the sheet material, but these studs may also be formed in advance with head and leg portions and supplied to the sheet material from supply means such as parts feeders for caulking by a punch and die set and subsequent mounting to the sheet material.

What is claimed is:

1. Apparatus for attaching a plurality of studs to a flexible sheet material, each of said studs having a head portion and at least one leg portion, said apparatus comprising, a frame having a work table, a holder for holding said flexible sheet material on said work table, supply means for supplying said studs one by one to said flexible sheet material, plastic working means including a punch and die set for attaching said studs on said flexible sheet material, said punch and die set being disposed oppositely on both sides of said flexible sheet material and relatively movable for plastic working action between a closed position and a separate position, said punch and die set being adapted to cause said leg portion of said stud to pierce through flexible sheet material and subsequently to cause said plastic working action against said leg portion for attaching said stud to said flexible sheet material according to the movement of said set of punch and die to said closed position, drive means for varying the relative position between said holder and said plastic working means, and control means for controlling the operation of said supply means and said drive means during said movement of said punch and die set in said separate position.

2. Apparatus for attaching a plurality of studs to a flexible sheet material according to claim 1, further comprising, memory means for storing a plurality of positional data representing said relative position, and wherein said control means controlling said drive means according to said positional data.

3. Apparatus for attaching a plurality of studs to a flexible sheet material according to claim 1, wherein said supply means includes metal strip feed means for intermittently feeding a metal strip through a zone between the die and the punch of said punch and die set, and plastic working means including at least one punch and die set for punching and forming said studs severally from said metal strip.

4. Apparatus for attaching a plurality of studs to a flexible sheet material according to claim 1, wherein said drive means includes a pair of pulse motors for moving said holder.

5. Apparatus for attaching a plurality of studs to a flexible sheet material, each of said studs having a head portion and plurality of leg portions, said apparatus comprising, a frame having a work table, a holder for holding said flexible sheet material on said work table, metal strip feed means for intermittently feeding a metal strip, first plastic working means including at least a first punch and die set for punching and forming said studs severally from said metal strip, said first punch and die set being disposed oppositely on both sides of said metal strip and relatively movable to each other between a closed position and a separate position for plastic working of said stud, said first punch and die set being adapted to form said head portion and said plurality of leg portions on said metal strip during movement to said closed position, second plastic working means including a second punch and die set for attaching said studs to said flexible sheet material, said second punch and die set being disposed oppositely on both sides of said flexible sheet material and relatively movable to each other between a closed position and separate position for plastic working of said stud, said second punch and die set being adapted to sever said stud from said metal strip and thereafter to cause said plurality of leg portions of said stud to pierce through said flexible sheet material and subsequently to bend said plurality of leg portions for attaching said stud to said flexible sheet material according to the movement of said second punch and die set to said closed position, drive means for varying the relative position between said holder and said both plastic working means, and control means for controlling the operation of said metal strip feed means and said drive means during said movement of said first and second punch and die sets to said separate position.

6. Apparatus for attaching a plurality of studs on a flexible sheet material according to claim 5, wherein said first plastic working means includes two punch and die sets for punching and forming said studs severally from said metal strip, one of said sets being adapted to draw said metal strip for forming said head portion, and the other of said sets being adapted to cut and bend said metal strip for forming said plurality of leg portions.

7. Apparatus for attaching a plurality of studs to a flexible sheet material, each of studs having a head portion and plurality of leg portions, said apparatus comprising, a frame having a work table, a holder for holding said flexible sheet material on said work table, metal strip feed means for intermittently feeding a metal strip in the state spaced from said flexible sheet material, means for blanking a stud element from said metal strip to form said head portion and said plurality of leg portions, means for drawing said stud element in the direction of said flexible sheet material to form said stud, means for reversing the stud drawn by said drawing means so as to cause said leg portions to face to said flexible sheet material, plastic working means including a punch and die set for attaching said stud to said flexible sheet material, said punch and die set being disposed oppositely on both sides of said flexible sheet material and relatively movable to each other between a closed position and a separate position for plastic working of said stud, said punch and die set being adapted to cause said plurality of leg portions of said stud reversed by said reversing means to pierce through said flexible sheet material and subsequently to bend said plurality of leg portions for attaching said stud to said flexible sheet material according to the movement of said punch and said die to said closed position, drive means for varying the relative position between said holder and said plastic working means, and control means for controlling the operation of said metal strip feed means and said drive means during said movement of said punch and die set to said separate position.

8. Apparatus for attaching a plurality of studs to a flexible sheet material, each of studs having a head portion and a plurality of leg portions, said apparatus comprising, a frame, means for blanking a stud element from a metal strip to form said head portion and said plurality of leg portions, said blanking means including a reciprocable blanking punch disposed at one side of said metal strip and die disposed at other side of said metal strip, means for drawing said stud element to form said stud, said drawing means including a reciprocable drawing punch and a die, a rotatable member supported on said frame and rotatable about an axis perpendicular to the longitudinal axis of said reciprocable drawing punch, said rotatable member having a bore aligned with said longitudinal axis of said reciprocable drawing punch, each end of said bore being adapted to hold said stud moved by said reciprocable drawing punch at one end each time said reciprocable drawing punch is moved in the drawing direction, means for reversing said rotatable member by one half revolution each time said drawing punch is moved to a retracted position so as to cause the other end of said bore to face to said drawing punch alternately, a stud attaching punch disposed in said bore and adapted to be moved by said drawing punch through said stud held in said bore, said stud attaching punch being adapted to move said stud held in said bore and to cause said leg portions of said stud to pierce through said flexible sheet material upon movement of said stud attaching punch, and a stud attaching die disposed oppositely to said stud attaching punch and adapted to bend said plurality of leg portions for attaching said stud to said flexible sheet material.

* * * * *